United States Patent [19]

Kawamura et al.

[11] Patent Number: 4,730,733

[45] Date of Patent: Mar. 15, 1988

[54] SYSTEM FOR DELIVERING AND INSPECTING PACKAGES

[75] Inventors: Shuzo Kawamura, Joyo; Kazuo Nakanishi, Uji, both of Japan

[73] Assignee: Murata Kikai Kabushiki Kaisha, Kyoto, Japan

[21] Appl. No.: 903,678

[22] Filed: Sep. 4, 1986

[30] Foreign Application Priority Data

Sep. 6, 1985 [JP] Japan ..... 60-197417
Sep. 9, 1985 [JP] Japan ..... 60-200116

[51] Int. Cl.[4] ..... B07C 5/02; B07C 5/36; B65G 43/08

[52] U.S. Cl. ..... 209/538; 57/281; 198/351; 198/409; 198/464.1; 198/468.6; 198/487.1; 209/556; 209/587; 209/593; 209/927; 242/35.5 A

[58] Field of Search ..... 209/509, 538, 540, 541, 209/542, 545, 552, 555, 556, 559, 560, 562–565, 587, 592–595, 651–654, 659, 903, 919, 922, 927; 57/270, 281; 198/351, 352, 354, 355, 409, 464.1, 468.6, 487.1, 586, 803.12; 242/35.5 A

[56] References Cited

U.S. PATENT DOCUMENTS

| | | | |
|---|---|---|---|
| 2,256,684 | 9/1941 | Morgan et al. | 198/468.6 |
| 2,794,532 | 6/1957 | Snow | 242/35.5 A X |
| 3,410,406 | 11/1968 | Tsuda et al. | 209/927 X |
| 3,589,498 | 6/1971 | Cowan et al. | 198/352 |
| 3,854,275 | 12/1974 | Bethea et al. | 57/281 |
| 4,193,502 | 3/1980 | Marmo | 209/555 |
| 4,309,000 | 1/1982 | Schefer et al. | 242/35.5 A X |
| 4,351,494 | 9/1982 | Schippers et al. | 242/35.5 A |
| 4,555,215 | 11/1985 | Raasch et al. | 242/35.5 A X |
| 4,586,326 | 5/1986 | Igel | 57/281 |
| 4,598,869 | 7/1986 | Uchida et al. | 209/927 X |
| 4,651,865 | 3/1987 | Kupper et al. | 242/35.5 A X |
| 4,667,807 | 5/1987 | Sanno | 198/803.12 X |

FOREIGN PATENT DOCUMENTS

| | | | |
|---|---|---|---|
| 0157964 | 12/1982 | Fed. Rep. of Germany | 242/35.5 A |
| 0719941 | 3/1980 | U.S.S.R. | 198/468.6 |

*Primary Examiner*—Robert B. Reeves
*Assistant Examiner*—Edward M. Wacyra
*Attorney, Agent, or Firm*—Spensley Horn Jubas & Lubitz

[57] ABSTRACT

A system for delivering and inspecting packages including an apparatus for delivering packages and an inspecting device of packages delivered from the apparatus. The apparatus for delivering packages comprises a first delivering device for receiving packages from a path of their transportation and a second delivering device for receiving the package from the first delivering device and delivering them to the inspecting device. Each of the first and second delivering devices include a package receiving member and a mechanism for changing the package receiving position of the package receiving member in accordance with the kind of the packages.

17 Claims, 25 Drawing Figures

SYSTEM FOR DELIVERING AND INSPECTING PACKAGES

FIELD OF THE INVENTION AND RELATED ART STATEMENT

This invention relates to an apparatus for delivering wound yarn packages from a path of their transportation to a package disposal station and an inspection device of the packages.

There are known various types of apparatus including, for example, a hook conveyor adapted to travel along an overhead rail for conveying automatically wound packages along a path of their transportation to a predetermined station where the packages are unloaded from the conveyor.

Systems for manufacturing many kinds of products each in a small quantity are now often used. The packages which must be conveyed by the conveyor as hereinabove described are also of various shapes and sizes.

If the packages which are conveyed are all of the same shape and size, it is sufficient to use a delivering apparatus having a package receiving member which is merely movable between a raised receiving position and a lowered delivering position. No such apparatus can, however, be used for delivering differently sized packages down to the desired positions which differ from one size of packages to another.

OBJECT AND SUMMARY OF THE INVENTION

It is an object of this invention to provide an apparatus which is suitable for delivering differently sized packages, particularly ones of different diameters, from a path of their transportation to their respective desired positions correctly.

According to this invention, therefore, there is provided an apparatus which comprises a first delivering device for receiving packages from a path of their transportation, a second delivering device for receiving the packages from the first delivering device and delivering them to a predetermined disposal station, each of the first and second delivering devices having a package receiving member, and a mechanism provided on each of the delivering devices for changing the package receiving position of its package receiving member in accordance with the nature of the packages.

An inspection station for inspecting the quality of the packages may be provided at the disposal station.

BRIEF DESCRIPTION OF THE DRAWINGS

FIGS. 15 to 24 show the various mechanisms in the inspection station, FIG. 15 being a top plan view of the inspection station, FIG. 16 being a partly omitted sectional view taken along the line XVI—XVI of FIG. 15, FIG. 17 being a sectional view taken along the line XVII—XVII of FIG. 15, FIG. 18 being a front elevational view, partly in section, of the driving system in the inspection station, FIG. 19 being a top plan view thereof, FIG. 20 being a front elevational view, partly in section, showing a peg on the rotating member, FIGS. 21 and 22 showing a specific example of the first inspection device, FIG. 21 being a front elevational view, partly in section, thereof, while FIG. 22 is a top plan view thereof, FIG. 23 being a top plan view of the clutch mechanism for the cam shaft in the driving system and FIG. 24 being a front elevational view thereof.

DETAILED DESCRIPTION OF PREFERRED EMBODIMENTS

Figure 1:
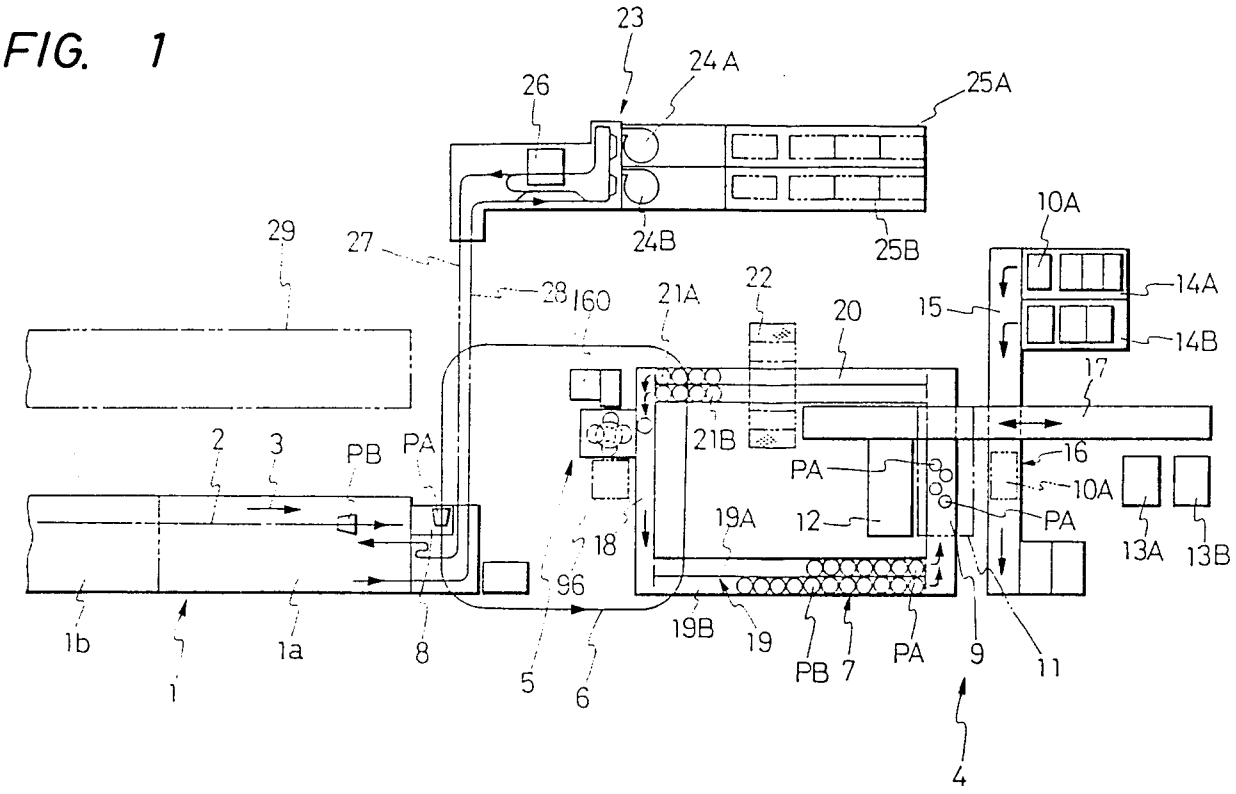
FIG. 1 is a diagram showing the layout of a package transportation system by way of example.

Referring to the drawings, an apparatus of the present invention will be described.

An embodiment of the invention will now be described by way of example with reference to an apparatus which is applicable to two kinds of conical packages on which yarn has been wound by a single winder divided into two sections, and which differ from each other in the diameter of the yarn layer wound thereon.

FIG. 1 shows the layout of a package transportation system by way of example. An automatic winder 1 comprises a plurality of winding units juxtaposed to one another and is substantially divided into two sections 1*a* and 1*b*. The winding section 1*a* forms packages of one product A and the winding section 1*b* forms packages of another product B. The packages PA and PB thereby formed are conveyed in the direction of an arrow 3 by a belt 2 traveling along the units.

A packing station 4 where the packages are packed in boxes is provided beside the winder 1. An inspection station 5 for inspecting the quality of the packages is located between the winder 1 and the packing station 4. A first package transportation line 6 is provided between the winder 1 and the inspection station 5 and may, for example, comprise an overhead traveling conveyor. A second package transportation line 7 is provided between the inspection station 5 and the packing station 4 for conveying the inspected packages and storing them prior to packing. The line 7 may, for example, comprise a belt conveyor.

The lifter as disclosed in Japanese Laid-Open Utility Model Specification No. 50957/1984 can, for example, be used as a device 8 for transferring the packages from the winder to the first package transportation line 6 comprising an overhead traveling conveyor which is movable in the direction of an arrow.

The packing station 4 comprises a boxing robot 11 for placing in a box 10A a plurality of inspected packages PA or PB of the same kind selected from the packages on a conveyor 9, a device 12 for inverting the conical packages to enable their efficient packing, boxes 13A and 13B for supplying board for dividing the packages from one another in the box, and sections 14A and 14B for stocking empty boxes. If, for example, the packages of the product A are going to be packed, empty boxes 10A are conveyed to a packing position 16 on a conveyor 15 one after another and the robot 11 is moved to the same position along an overhead rail 17 which is perpendicular to the conveyor 15. The robot 11 automatically places packages PA and dividing boards in empty boxes 10A one after another.

The second package transportation line 7 comprises a closed loop of conveyor belts 18, 19, 9 and 20. Transporting mediums (trays 21A and 21B) for carrying the two kinds of packages, respectively, are selectively transferred onto the conveyor 18 facing the inspection station 5 to receive the inspected packages and are, then, transferred onto package storing conveyors 19A and 19B, respectively. The packages PA are stored on the conveyor 19A and the packages PB on the conveyor 19B. A stairway 22 extends over the conveyor 20.

A bobbin supply station 23 is appropriately located for supplying spinning bobbins to the automatic winder 1. The station 23 includes two devices 24A and 24B for feeding two kinds of bobbin trays with two kinds of bobbins, respectively, two sections 25A and 25B for storing bobbin boxes containing new bobbins, and a device 26 for finding the end of yarn on each bobbin on a tray. The bobbins leaving the device 26 are supplied to the winder 1 by a bobbin supply conveyor 27 and distributed to either of the two winder sections by a discriminating device not shown. The empty bobbins or bobbins on which some yarn remains are returned from the winding units to the bobbin supply station 23 by a return conveyor 28.

Numeral 29 in FIG. 1 may designate another winder for winding a different kind of yarn from that which is handled by the winder 1, or a spinning frame which supplies bobbins to the bobbin supply station. The bobbin supply station 23 can also be positioned in a location other than that shown in FIG. 1. The packing station 4 can also be located in a different place.

A device 160 for delivering packages from the overhead traveling conveyor line 6 to the inspection station 5 will now be described with reference to FIGS. 2 to 14.

(I) Conveyor line for package transportation

Figure 2:
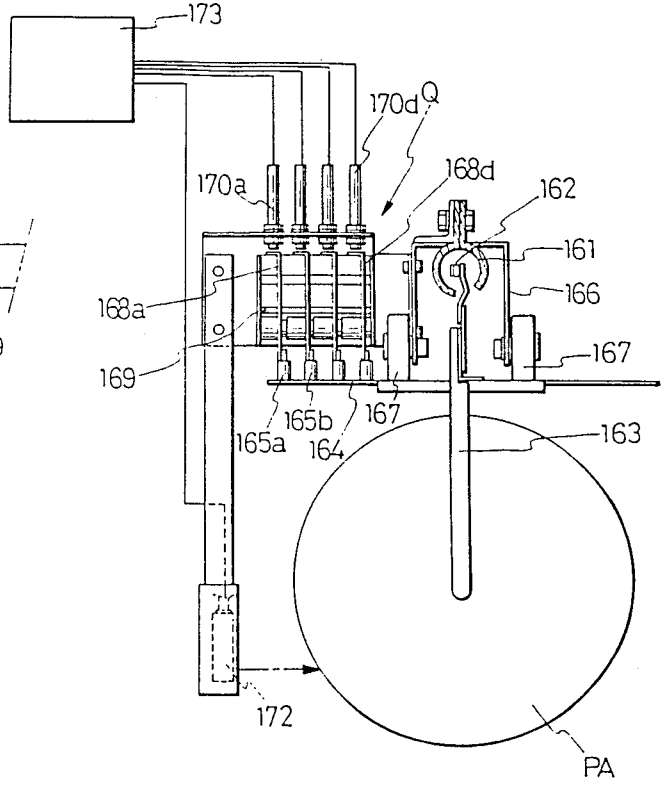
FIG. 2 is a side elevational view of a package transportation line.
Figure 3:
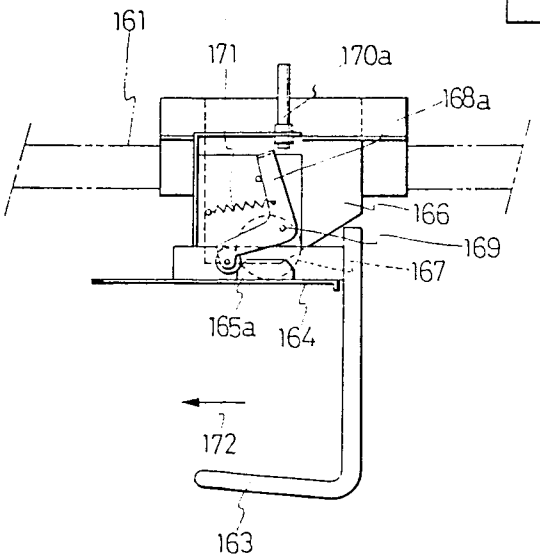
FIG. 3 is a front elevational view thereof.

An overhead traveling conveyor line for delivering packages from the winder is shown by way of example in FIGS. 2 and 3. It comprises a hook conveyor and a mechanism for identifying the package on the hook conveyor. A chain 162 is provided in a guide rail 161 defining a path of transportation. An L-shaped package carrying hook 163 is connected to the chain 162 for carrying a package PA with the movement of the chain. A guide plate 164 forms an integral part of the hook 163 and is provided for controlling the position of a package in a package delivery position or the position of any of package identifying cams. Insofar as the apparatus shown is designed for handling two kinds of packages PA and PB, only a cam 165*a*, out of cams 165*a* to 165*d*, is, for example, positioned on the plate 164 as shown so that the hook having the cam 165*a* may carry only packages of the product A, while the hook having only the cam 165*b* carries only packages of the product B. A bracket 166 is secured to the guide rail 161. A pair of guide rollers 167 are supported on the bracket 166 on the opposite sides, respectively, of the hook. A plurality of levers 168*a* to 168*d* are rotatably supported on a shaft 169 and a plurality of proximity sensors 170*a* to 170*d* are provided for the levers, respectively. The levers 168*a* to 168*d* are normally kept away from the sensors 170*a* to 170*d*, respectively, by springs 171, as shown in FIG. 3. If the hook 163 and therefore the guide plate 164 move in the direction of an arrow 172, the lever 168*a* corresponding to the cam 165*a* on the guide plate 164 is rotated by overcoming the force of the spring 171 and thereby turns on the proximity sensor 170*a*. When the proximity sensor 170*a* is turned on, it provides a signal indicating the arrival of a package of the product A and when the sensor 170*b* is turned on, it provides a signal indicating the arrival of a package of the product B, whereby the package to be delivered to the inspection station is identified. The package on the hook is detected at 172 and the identifying signal and the package detecting signal are transmitted to a control device 173 which in turn causes the delivering devices to work in accordance with the kind of the package as will hereinafter be described.

(II) First package delivering device

Figure 4:
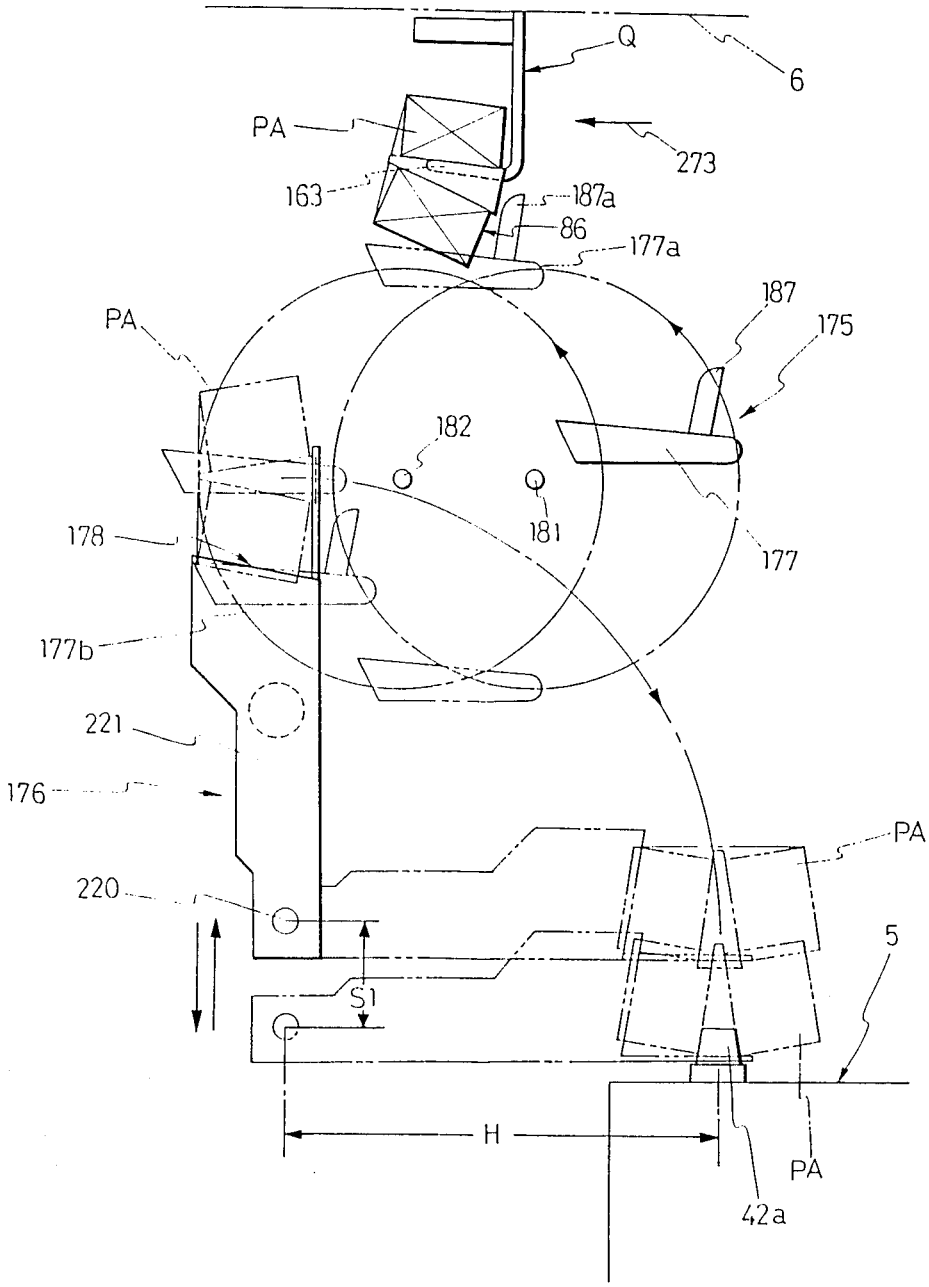
FIG. 4 for delivering packages from the transportation line to an inspection station.

Reference is made to FIG. 4 showing a first delivering device 175 which removes a package PA from the hook conveyor 163, and a second delivering device 176 which receives the package from the first delivering device and delivers it to a peg on the inspection station. The first delivering device 175 has a package receiving member 177 on which the package is mounted, and the second delivering device 176 has a package receiving member 178 which receives the package PA from the first delivering device. The package receiving member 178 swings with a swinging member 179 for transferring the package PA to the inspection station.

Figure 5:
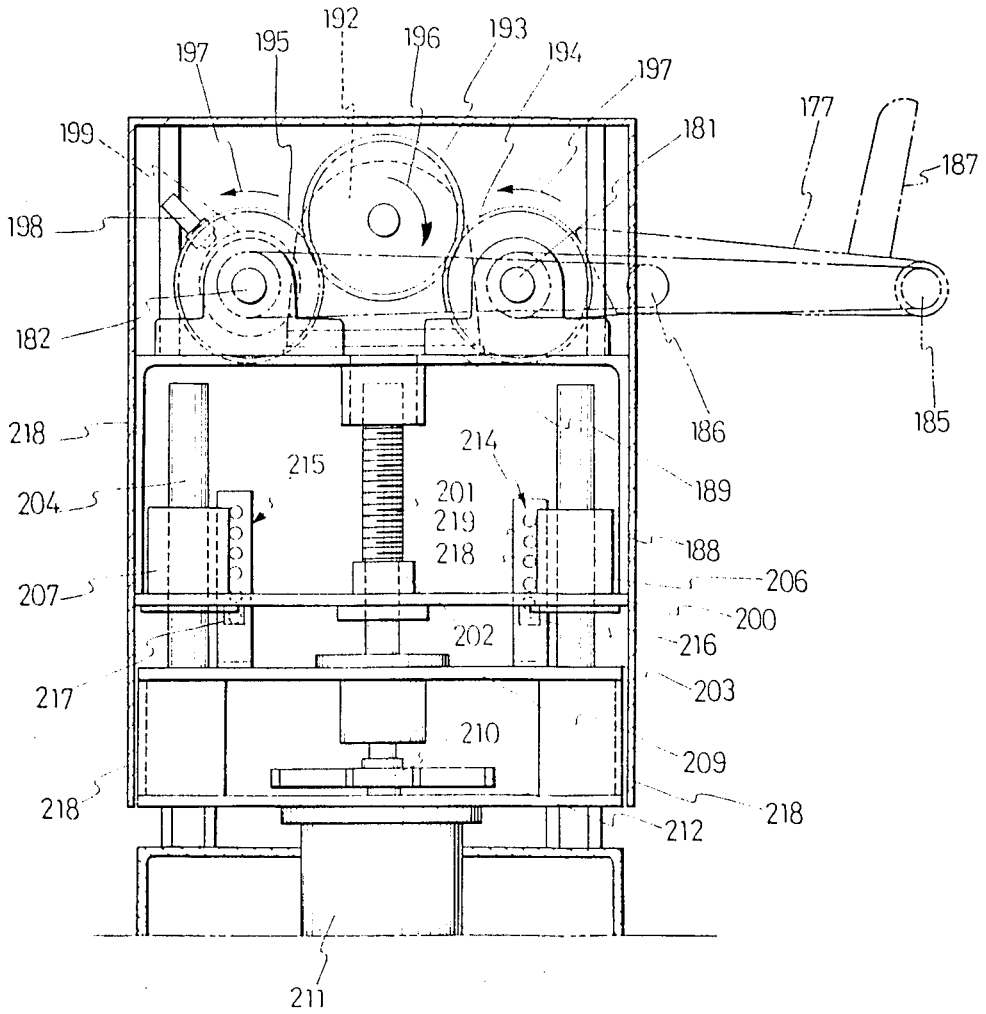
FIG. 5 is a front elevational view of the first delivering device.
Figure 6:
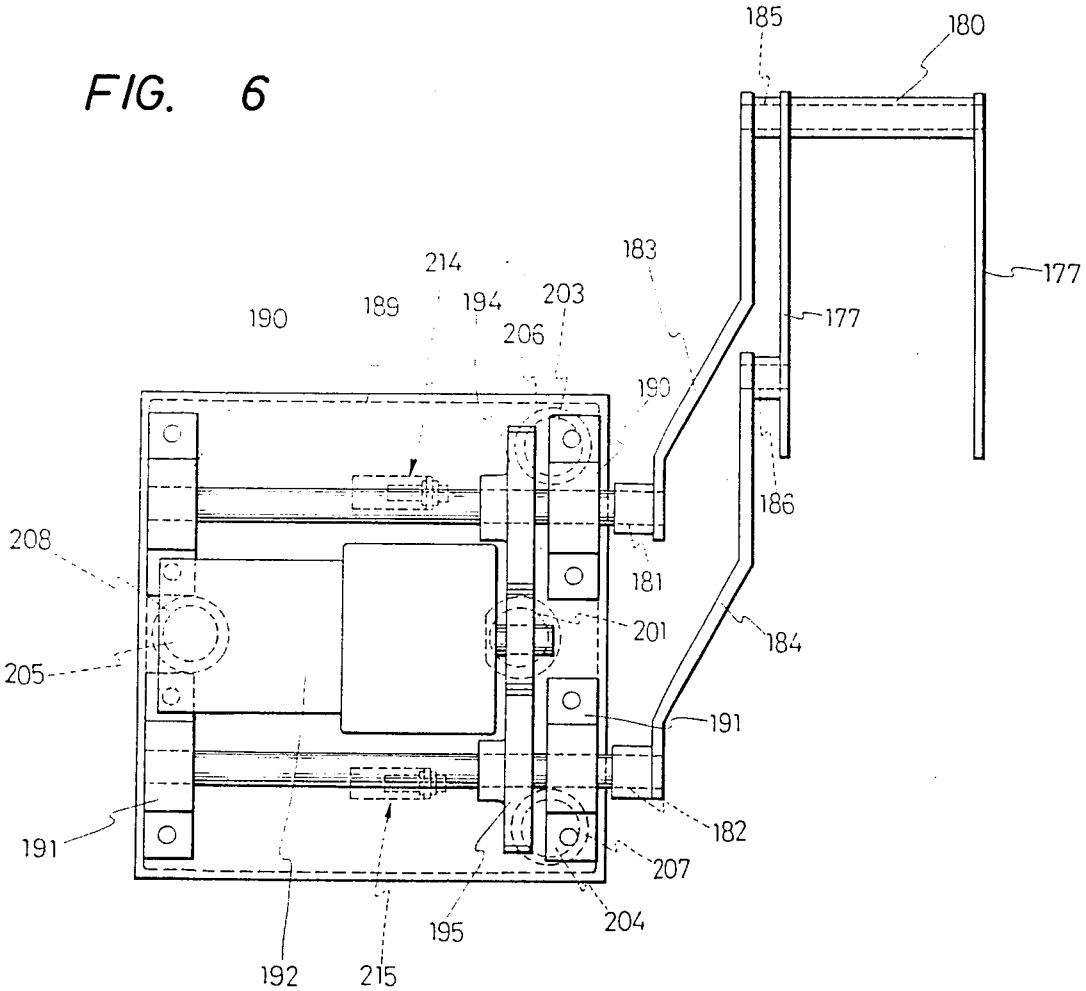
FIG. 6 is a top plan view thereof.
Figure 7:
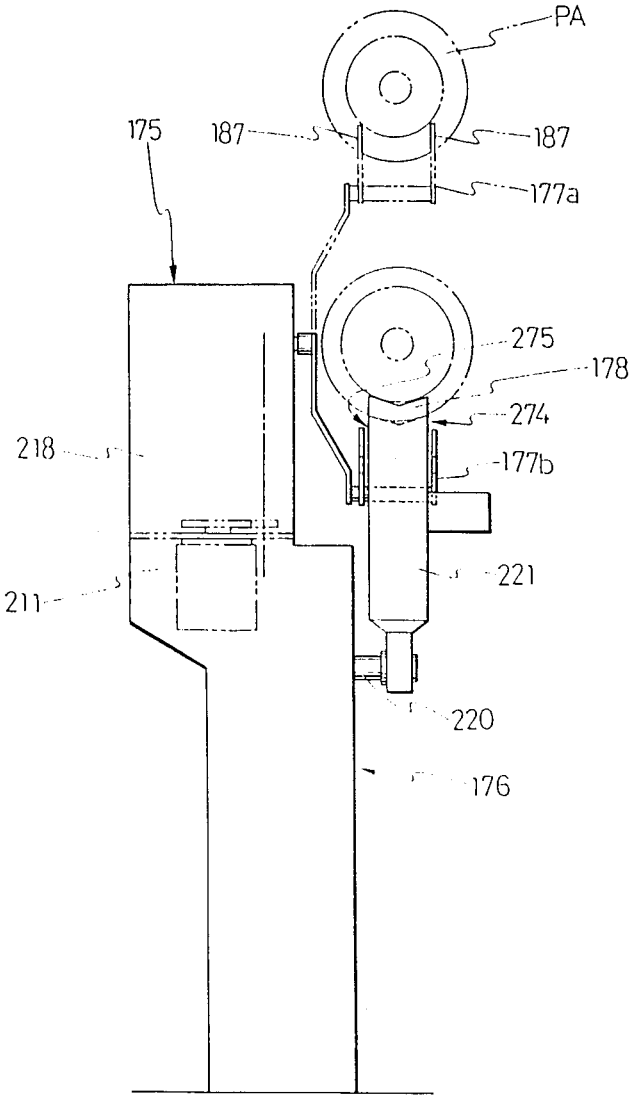
FIG. 7 is a schematic side elevational view of the first and second delivering devices.

The first delivering device 175 is shown in FIGS. 5 to 7. It has a pair of package receiving members 177 connected at one end to each other by a bar 180. A pair of levers 183 and 184 which are secured at one end to shafts 181 and 182, respectively, have other ends supported on one of the package receiving members 177 rotatably at 185 and 186, respectively, and thereby form a link mechanism. The distance between the shafts 181 and 185 is equal to that between the shafts 182 and 186, so that if the shafts 181 and 182 are rotated synchronously, the package receiving members 177 may rotate about the shafts 181 and 182, while moving in parallel to each other. A pair of package holding members are shown at 187. The package receiving members 177 are rotatable in the plane in which the hook conveyor 163 travels.

The shafts 181 and 182 to which the levers 183 and 184 are secured are supported by bearings 190 and 191, respectively, on an upper frame 189 forming a part of a vertically movable frame 188. A motor 192 is mounted on the frame 188 and has a gear 193 meshing with a gear 194 secured to the shaft 181 and a gear 195 secured to the shaft 182. The gears 194 and 195 have the same diameter and the same number of teeth. The rotation of the gear 193 in the direction of an arrow 196 causes the gears 194 and 195 to rotate in the same direction shown by arrows 197. A proximity sensor 198 is provided for detecting an iron member 199 secured to the shaft 182 to thereby detect each rotation of the shaft 182. The vertically movable frame 188 also includes a lower frame 200. A ball screw 202 is secured to the lower frame 200. The ball screw 202 is threadedly fitted about a screw shaft 201 extending through the frame 200. Sliding guide members 206 to 208 are secured to the lower frame 200 slidably along guide rods 203 to 205, respectively.

The screw shaft 201 and the guide rods 203 to 205 are supported on a stationary frame 209. A gear 210 is secured to the lower end of the screw shaft. A motor 211 has a gear 212 meshing with the gear 210. If the screw shaft 201 is rotated in one direction or the other, the vertically movable frame 188 is raised or lowered to adjust the position of the package receiving levers 177 in accordance with the diameter of the package which they are going to receive. A pair of proximity sensor groups 214 and 215 are provided on the stationary frame 209 for detecting two iron members 216 and 217, respectively, which are secured to the vertically movable frame 188, so that the frame 188 may be stopped at the position of a selected proximity sensor. The sensor group 215 has a distance between its sensors which differs from the distance between the sensors of the group 214. The provision of the two sensor groups enables a finer control of the amount of vertical movement of the frame 188 than would be possible if only the sensor group 214 were provided. If only the sensor group 214 were provided, it would be impossible to move the frame 188 by any distance smaller than the distance between two adjoining sensors 218 and 219.

A cover 218 surrounds the frame 188, as shown in FIG. 5. It covers the screw shaft 201 and the sensors 214 and 215 even when the frame 188 is raised above its position shown in FIG. 5.

(III) Second package delivering device

The second package delivering device 176, which receives the packages from the first package delivering device 175 and delivers them to the inspection station as shown in FIG. 4, will be described with reference to FIGS. 8 to 13.

Figure 8:
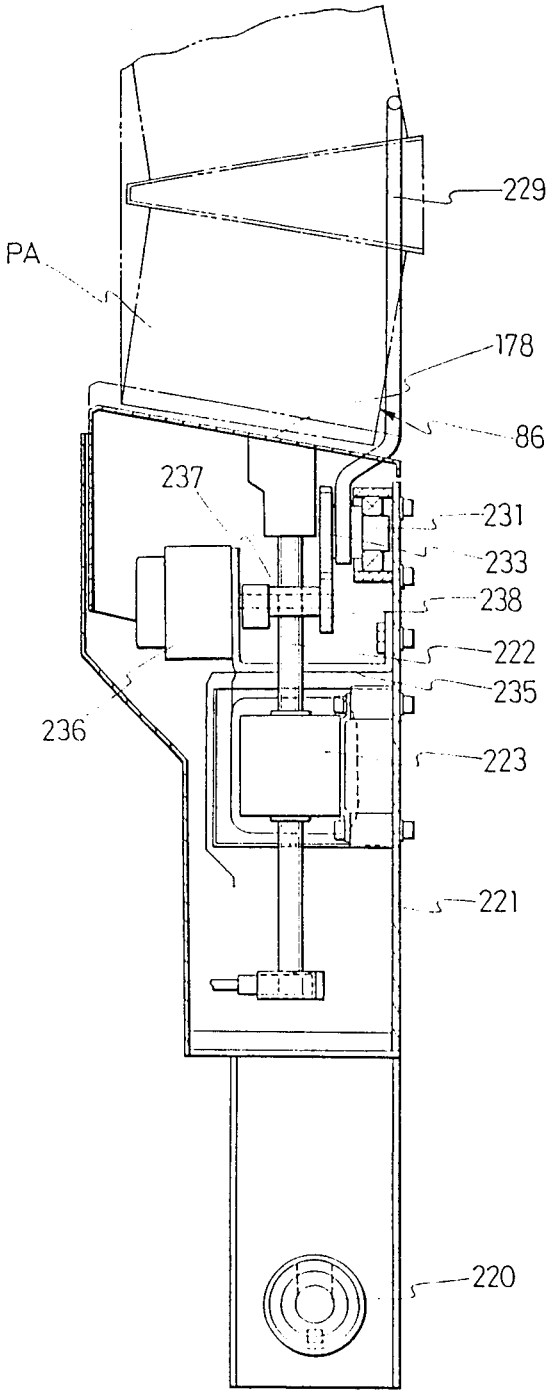
FIGS. 8 to 13 show the construction of the second delivering device, FIG. 8 being a front elevational view showing the swinging body in particular, FIG. 9 being a side elevational view thereof, FIG. 10 being a sectional view taken along the line X—X of FIG. 9, FIG. 11 being a front elevational view of the mechanism for moving the swinging shaft 220 vertically and rotating it, FIG. 12 being a side elevational view thereof and FIG. 13 being a top plan view thereof.
Figure 9:
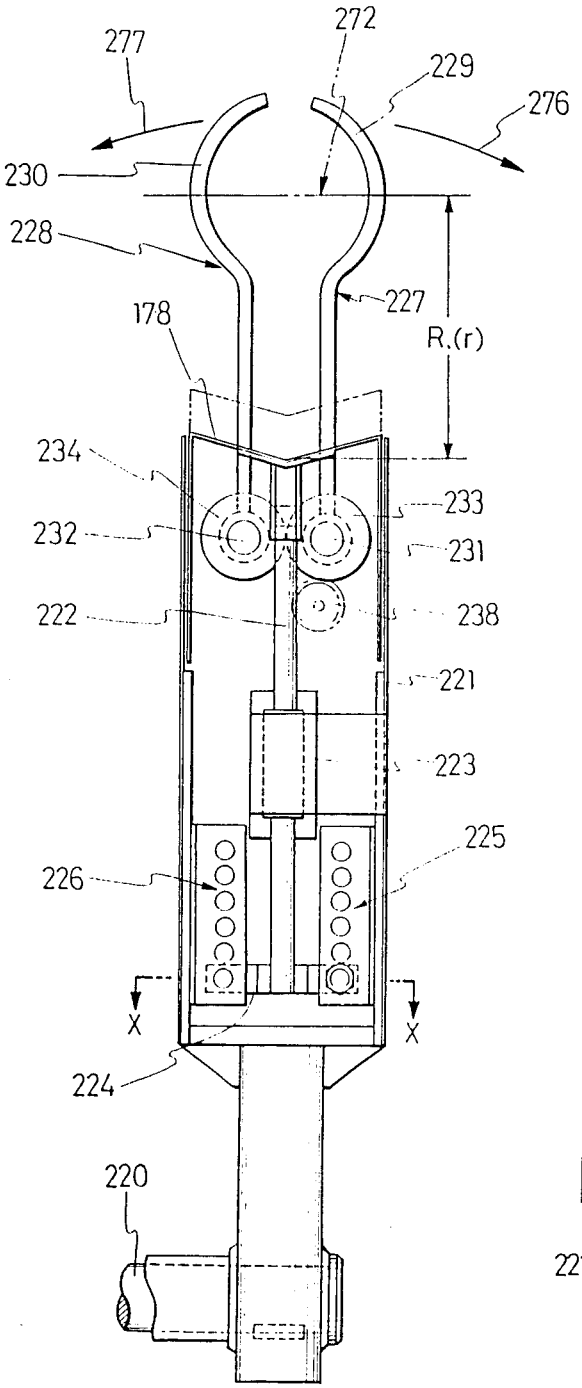
Figure 10:
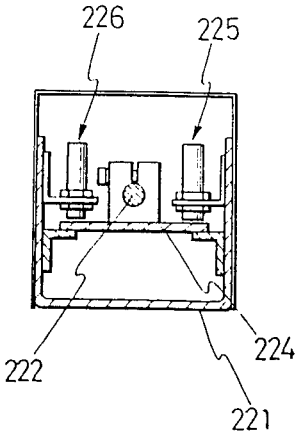

Referring to FIGS. 8 to 10, a swinging shaft 220 which is vertically movable and rotatable over a certain angular range is provided with a swinging body 221 and a package receiving member 178 which is vertically movably supported on the swinging body 221.

The package receiving member 178 has a package mounting surface which is mildly downwardly inclined toward its center so as to be complementary to the outer peripheral surface of a cheese package PA. A supporting rod 222 is secured to the bottom of the package receiving member 178. The rod 222 is vertically movable by a linear head 223 secured to the swinging body 221 to move the member 178 vertically in accordance with the diameter of the package so that it may smoothly receive the package from the first package delivering device 175. An iron member 224 is secured to the lower end of the rod 222 vertically movably therewith to actuate a pair of sensor groups 225 and 226 which are secured to the swinging body 221. The two sensor groups 225 and 226 are provided for the same reason as the two sensor groups shown in FIG. 5. The two sensor groups enable a smaller minimum distance of movement of the member 178 than would be possible if only one group of sensors were provided.

A pair of package supporting arms 227 and 228 are supported on the swinging body 221 movably to and away from each other. The arms 227 and 228 have portions 229 and 230, respectively, located at the end face 86 of a package PA to support it when the swinging body 221 is rotated about the shaft 220 by 90° clockwise as viewed in FIG. 8. The other ends of the arms 227 and 228 are secured to the shafts 231 and 232, respectively, which are rotatably supported by bearing in the swinging body. Gears 233 and 234 are secured to the ends of the shafts 231 and 232, respectively, and mesh with each other. The gear 233 mesh with a gear 238 secured to the output shaft 237 of a motor 236 supported on a bracket 235 in the swinging body 221. The rotation of the output shaft 237 in one direction or the other causes the movement of the arms 227 and 228 to or away from each other.

Figure 11:
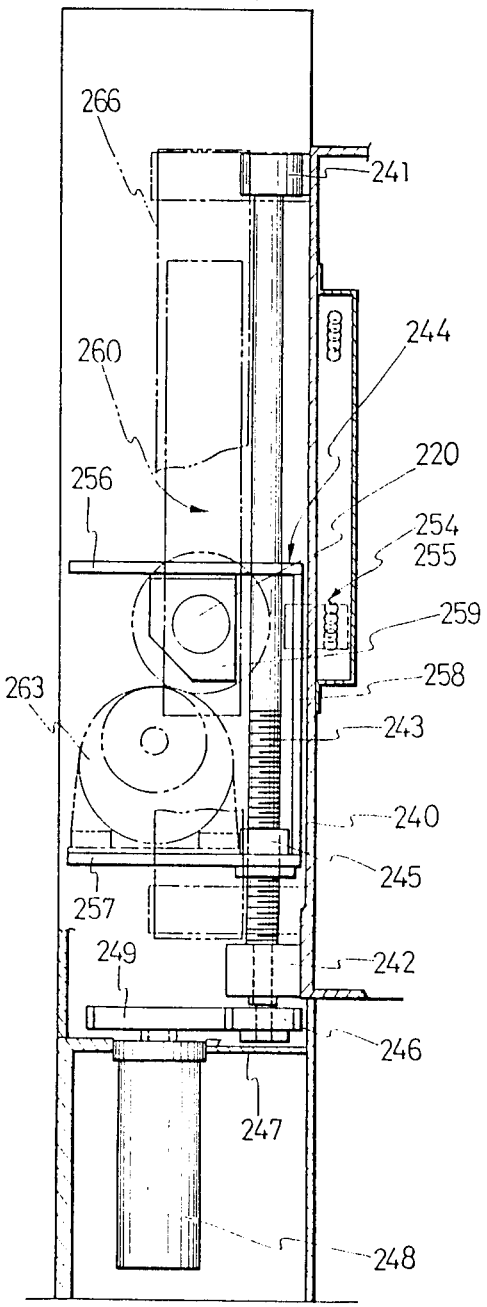
Figure 12:
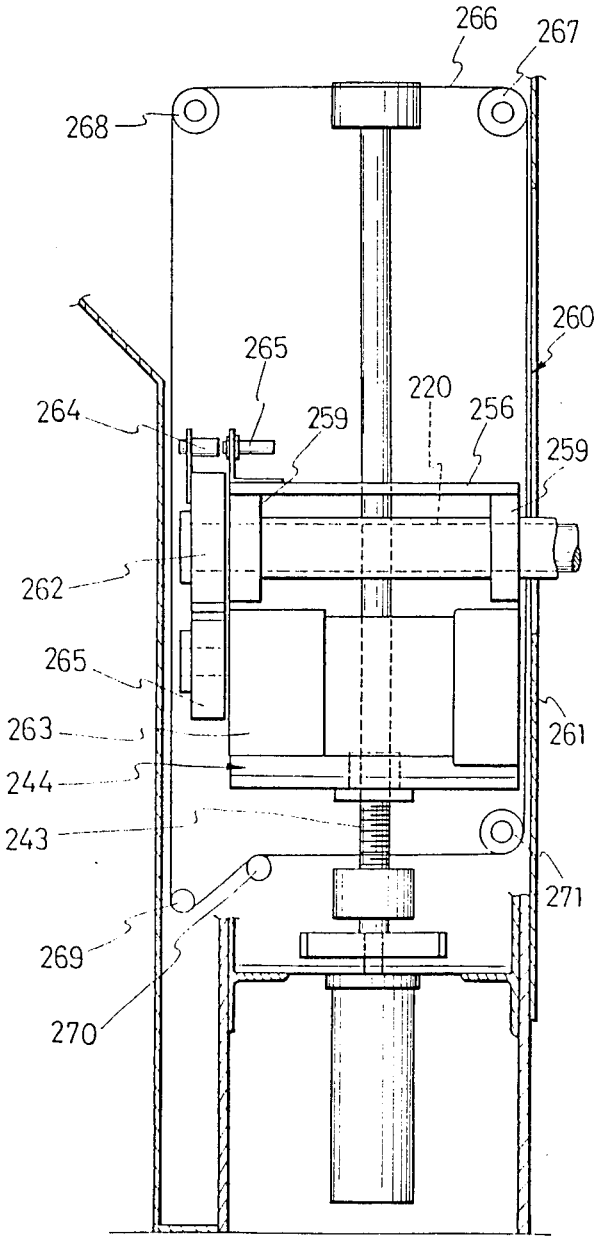
Figure 13:
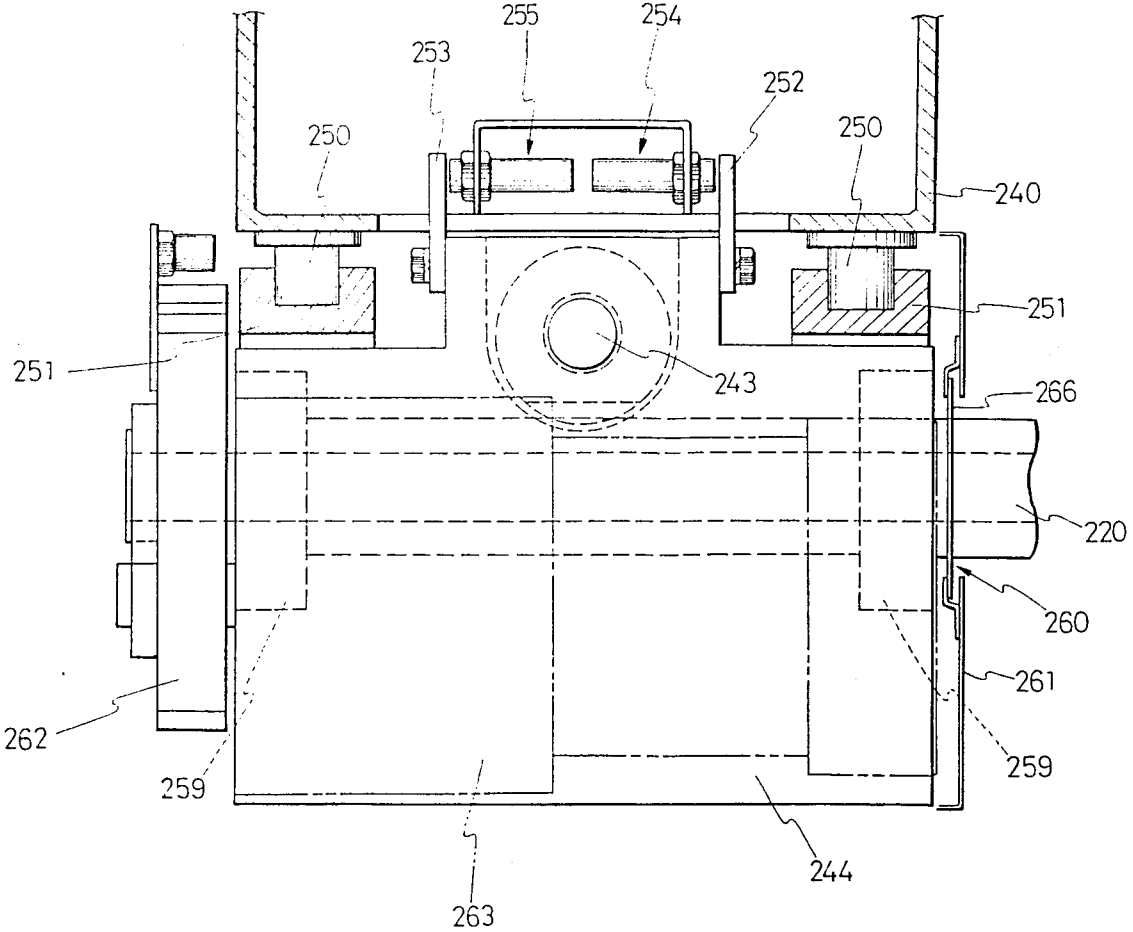

Reference is made to FIGS. 11 to 13 showing mechanisms for moving vertically and rotating the swinging shaft 220 to which the swinging body 221 is secured. A ball screw 245 which is secured to a vertically movable body 244 is threadedly engaged about a screw shart 243 supported by a pair of vertically spaced apart bearings 241 and 242 in a stationary frame 240. A gear 246 is secured to the lower end of the screw shaft 243. The gear 243 meshes with a gear 249 connected to a motor 248 mounted on a frame 247 so that if the motor 248 is driven, the screw shaft 243 may be rotated to move the body 244 vertically. Referring to FIG. 13, a pair of guide rails 250 are provided on the stationary frame 240 and a pair of guide members 251 are secured to the vertically movable body 244 slidably along the rails 250 to enable the body 244 to move only vertically.

The distance of vertical movement of the body 244 is controlled by a pair of iron members 252 and 253 secured to the body 244 and a pair of groups 254 and 255 of vertically spaced apart proximity sensors provided on the stationary frame 240, as shown in FIGS. 11 and 13.

The vertically movable body 244 comprises an upper frame 256, a lower frame 257 and a vertical frame 258. The screw shaft 243 extends vertically through the upper and lower frames 256 and 257. The swinging shaft 220 is supported by a pair of bearings 259 secured to the upper frame 255 and extends therethrough. A frame 261 has a vertically elongated opening 260 through which one end of the swinging shaft 220 to which the swinging body 221 is secured extends. A gear 262 is secured to the other end of the shaft 220 and meshes with a gear 265 secured to a motor 263 mounted on the lower frame 257. A dog 264 is secured to the gear 262 for actuating a proximity sensor 265 provided on the upper frame 256 to determine the rotating angle of the swinging shaft 220.

A flexible flat belt 266 covers the opening 260 to prevent flys, dust, etc. from entering the frame. The belt 266 has a width which is larger than that of the opening 260, and extends in an endless way about guide rollers 267 to 271, as shown in FIG. 12.

The belt 266 has a circular hole through which the swinging shaft 220 extends. The belt 266 is movable with the vertical movement of the shaft 220 by the distance over which the shaft 220 is moved. The opening 260 is always closed by the belt 266 so that no fly, dust, etc. may enter the opening.

Figure 14:
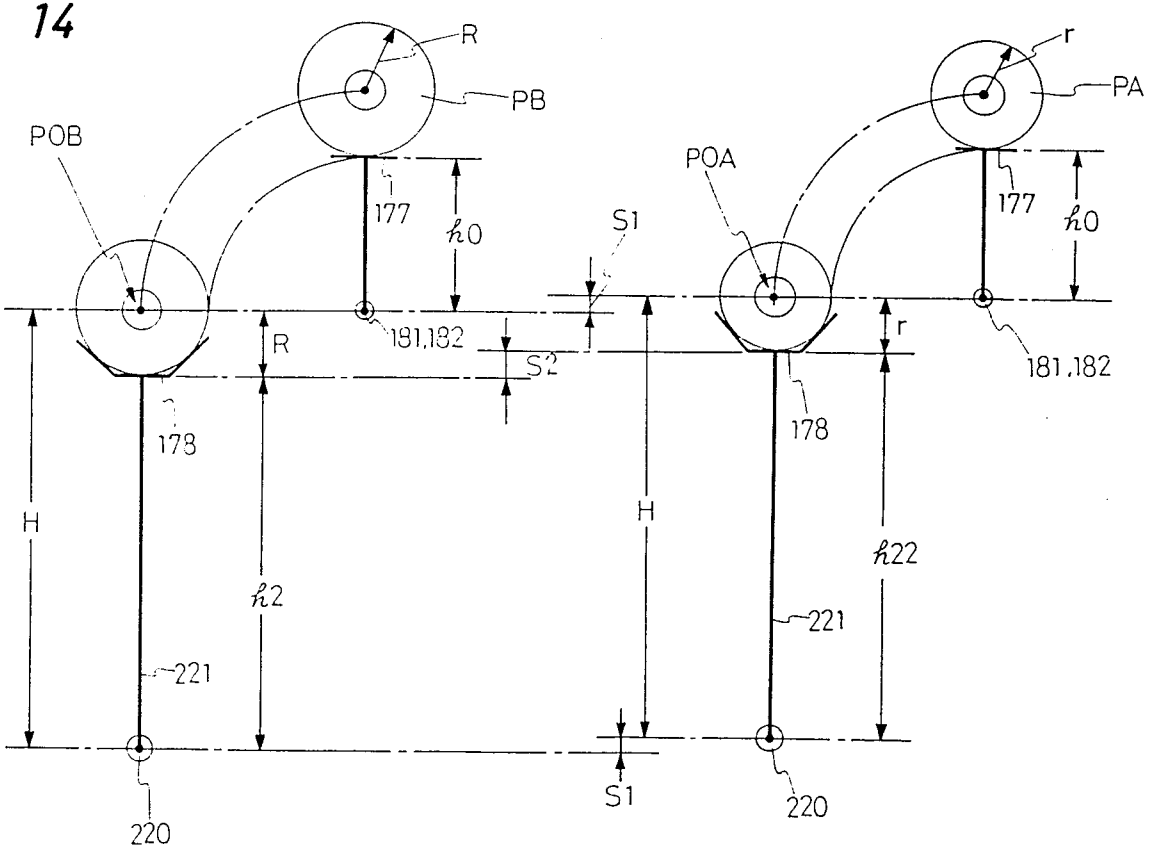
FIG. 14 is a diagram showing the positional relationship of the first and second delivering devices which is varied with a change in the diameter of the package to be handled.

Reference is now made to FIG. 14 showing the relationship between the first and second delivering devices 175 and 176. The left half of FIG. 14 shows a package PB received from the hook and having a radius R and the right half thereof shows a package PA received from the hook and having a radius r which is smaller than the radius R of the package PB, based on the positions of the devices 175 and 176 when they receive the package PB.

In the left half of FIG. 14, h0 is the distance between the shafts 181 and 182 of the first delivering device positioned for receiving the package PB and the package mounting surface of its package receiving members 177 and H is the distance between the center POB of the package on the package receiving member 178 of the second delivering device 176 which receives the package from the package receiving members 177 which have been rotated by 90° and the swinging shaft 220. The distance H is equal to the distance H between the swinging shaft 220 and a first peg 42*a* in the inspection station 5 (FIG. 4). Therefore, the distance H is equal to the distance h2 between the swinging shaft 220 and the package receiving member 178 plus the distance R between the package mounting surface of the member 178 and the center POB of the package (FIG. 14).

Referring to the right half of FIG. 14, the shafts 181 and 182 are raised above their positions shown in the left half thereof by a distance S1 which is equal to the difference R-r between the radii of the packages PB and PA so that the first delivering device 175 may receive the package PA. The motor 211 is driven to raise the vertically movable body 188 by the distance S1. When the package PA is transferred onto the package receiving member 178 by the first delivering device which is rotated about the shafts 181 and 182, it is necessary for the package to have its center POA at a level of height which is equal to that of the shafts 181 and 182. In other words, the distance between the package receiving member 178 and the center 272 of the curved portions of the arms 227 and 228 must be equal to the radius R or r of the package to be mounted on the member 178 (FIG. 9). Therefore, the package receiving member 178 is raised above the swinging body 221 by the distance S1 which is equal to the difference R-r. This is accomplished if the rod 222 is raised by the distance S1 by the linear head 223 (FIGS. 8 and 9). The swinging shaft 220 supporting the swinging body 221 is raised by the distance S1, whereby the center POA of the package on the package receiving member 178 coincides in height with the shafts 181 and 182, while the relationship shown in FIG. 9 is maintained.

The vertically movable body 244 carrying the shaft 220 is raised by the distance S1 if the motor 248 (FIGS. 11 and 12) is driven. As a result, the distance H between the center of the swinging shaft 220 and the center POA of the package as shown in the right half of FIG 14 is $h22+r=(h2+S1)+(R-S1)=h2+R$ and is, therefore, equal to the distance H shown in the left half thereof. S2 is the distance by which the package receiving member 178 is raised, and is $S1+S1=2S1$. In other words, the member 178 is raised by the distance which is equal to the distance by which it is itself raised, plus the distance by which the swinging body is raised.

The inspection station 5 will now be described more specifically with reference to FIGS. 15 to 25.

Figure 15:
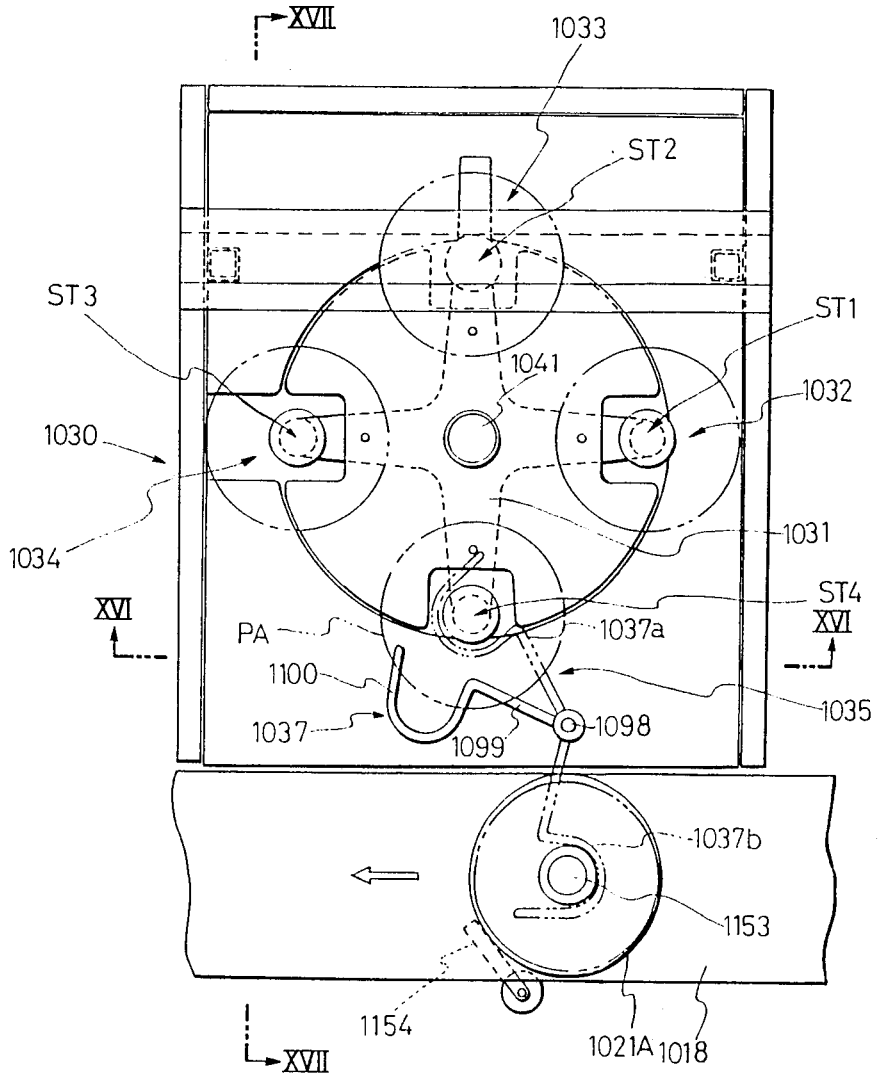
Figure 16:
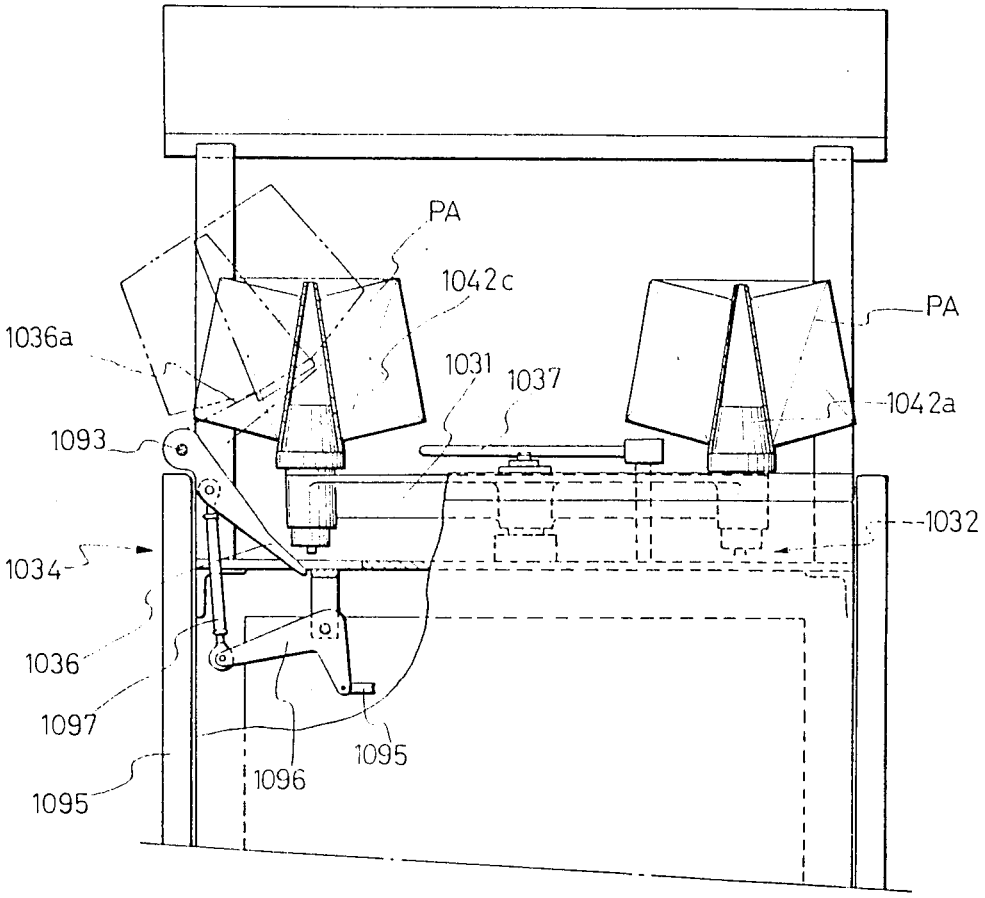
Figure 17:
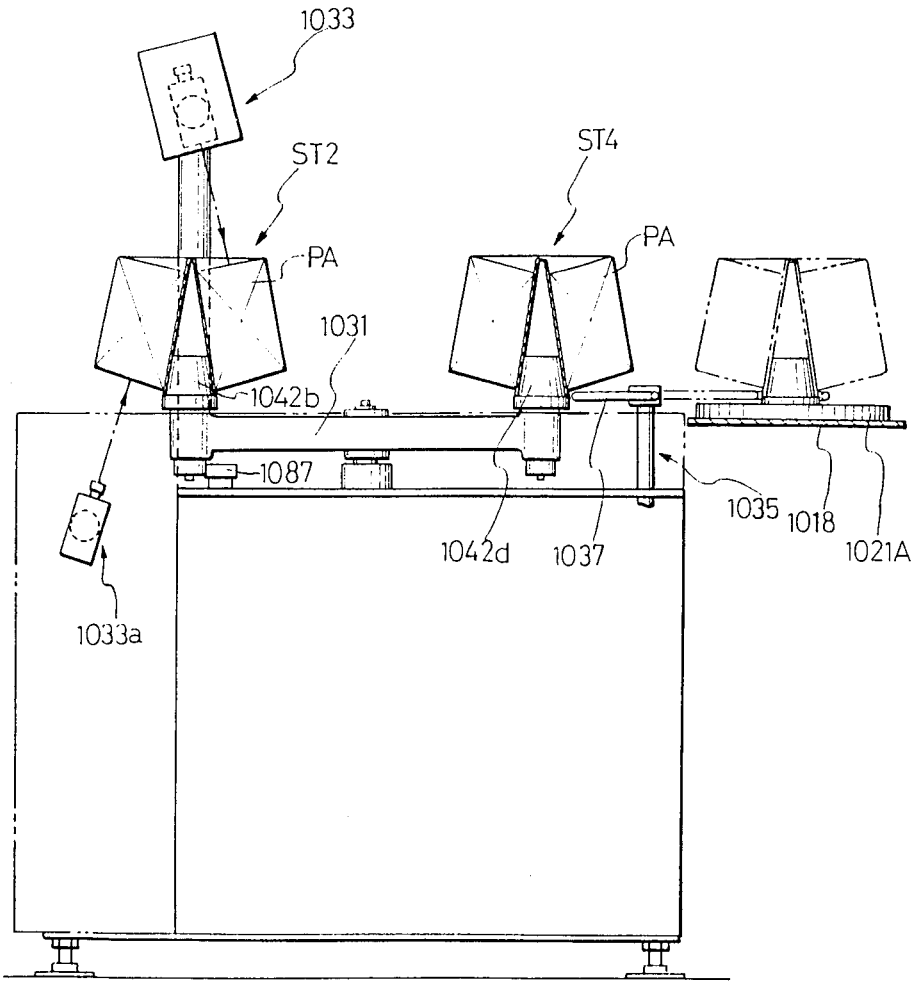

Referring to FIGS. 15 to 17, an inspection device 1030 comprises a turning member 1031 which is capable of supporting packages and rotating intermittently, a first inspection mechanism 1032, a second inspection mechanism 1033, a mechanism 1034 for ejecting a defective package and a mechanism 1035 for delivering an accepted package. The mechanisms 1032 to 1035 are located in the intermittently rotated positions, respectively, of the turning member 1031. Referring more particularly to FIG. 15, the turning member 1031 has an intermittently rotating angle of 90° and the mechanisms 1032 to 1035 are located in four stations ST1 to ST4, respectively.

The first inspection mechanism 1032 is a weighing mechanism for checking the weight of each package. The second inspection mechanism 1033 is a wound form inspection mechanism for checking the appearance of a layer of yarn on each package. The defective package discharging mechanism 1034 provided at station ST3 comprises a member 1036 for removing the packages rejected by at least one of the first and second inspection mechanisms from a line for the transportation of normal packages, and a mechanism for driving the ejecting member 1036. The package which has been accepted by both of the first and second inspection mechanisms passes through the station ST3 and is conveyed to the station ST4 where it is transferred by a transfer member 1037 from the turning member 1031 to a tray 1021A on a conveyor 1018.

The packages to be inspected are automatically supplied to the turning member 1031 by a package delivering device or robot not shown.

Each of the mechanisms will now be described in further detail.

(i) Turning member (1031)

Figure 18:
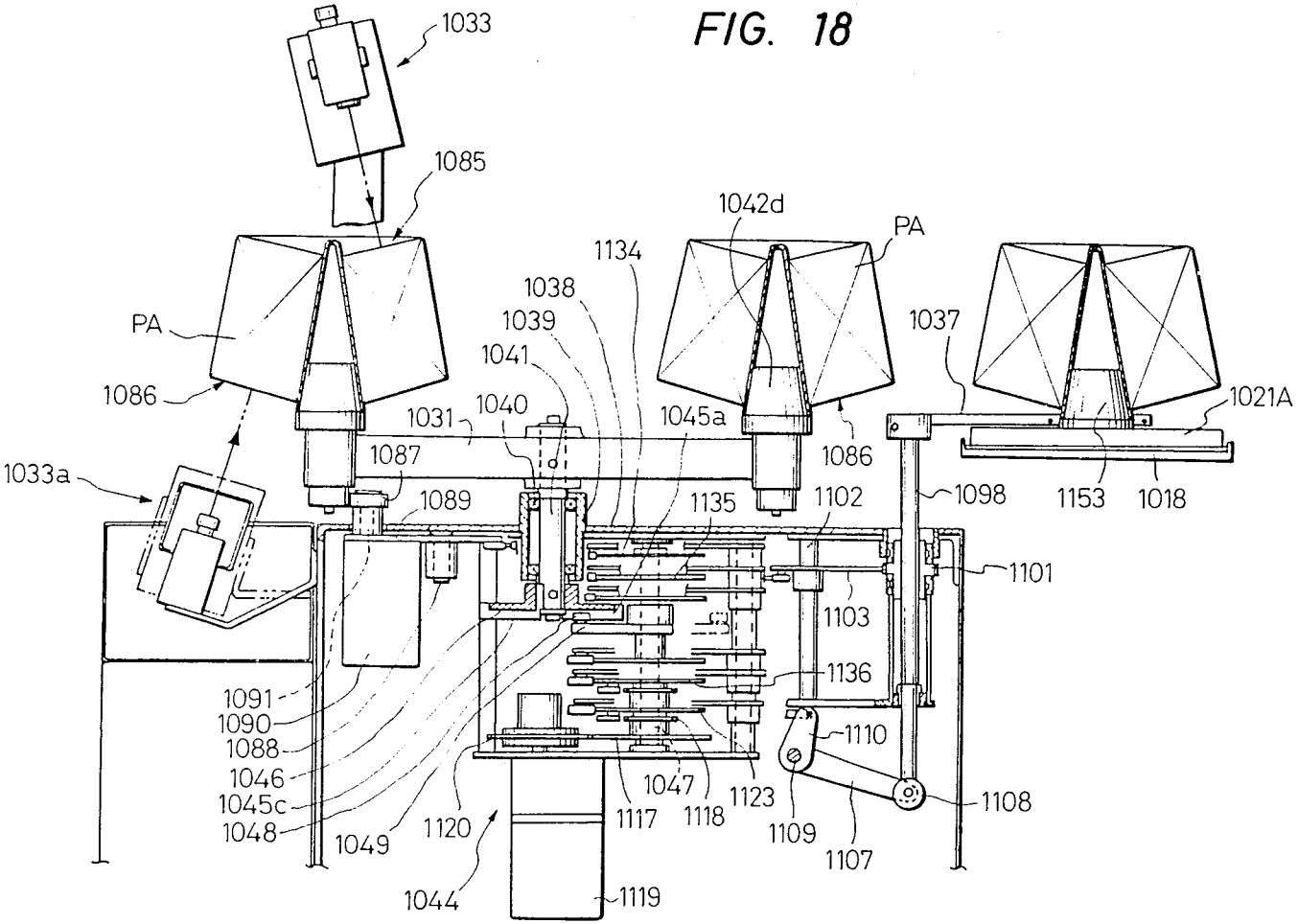
Figure 19:
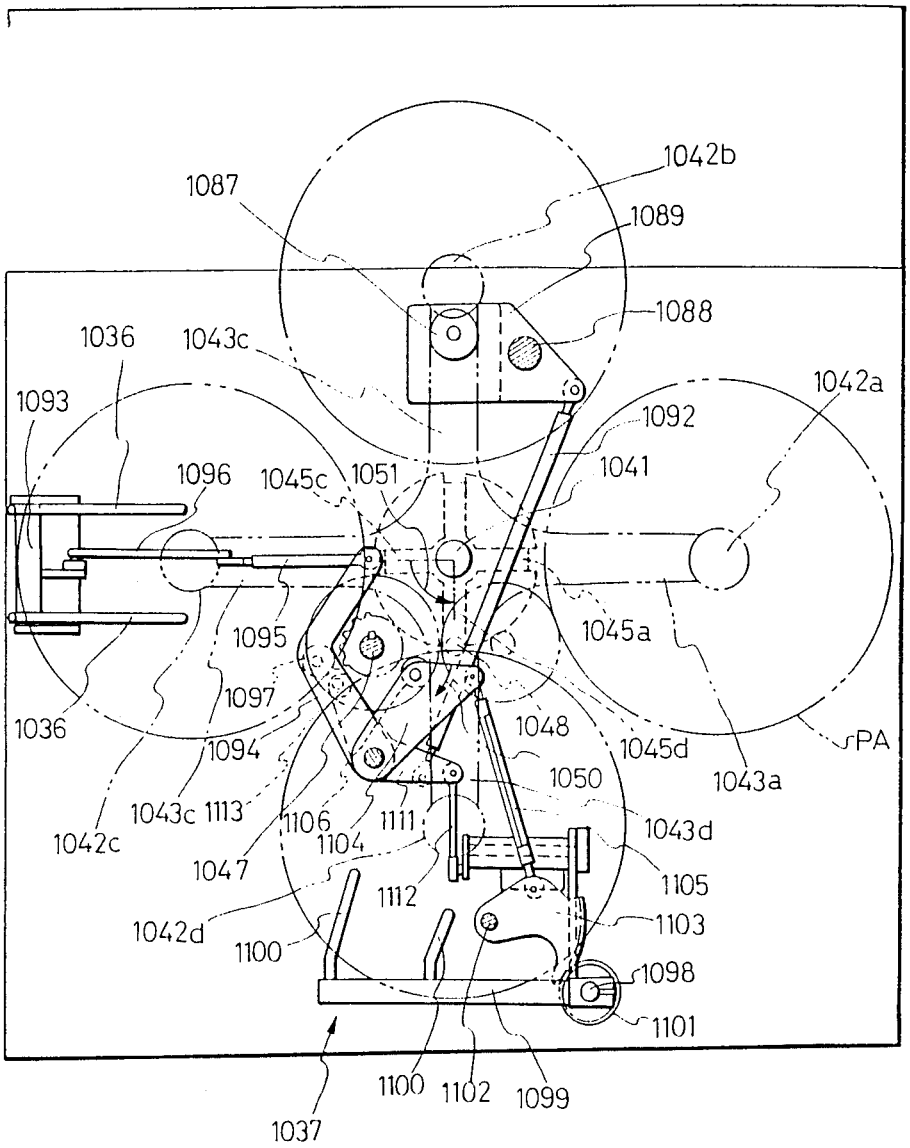

Referring to FIGS. 17 to 19, the turning member 1031 is secured to the upper end of a vertical shaft 1041 supported by bearings 1040 in a sleeve 1039 secured to a frame 1038.

The turning member 1031 includes four package supporting pegs 1042*a* to 1042*d* located at equal intervals on a circle having its center at the shaft 1041 and four arms 1043*a* to 1043*d* on which the pegs 1042*a* to 1042*d* are respectively supported. The distance of the pegs 1042*a* to 1042*d* from the center of the shaft 1041 or the radius of their rotation depends on the diameter of the packages PA supported on the pegs and is also limited by the various mechanisms with which the rotating member is associated. The distance is, however, at least such that the packages supported by the pegs do not interfere with one another, while the time required for the intermittent transfer of packages for inspection can be minimized.

Referring to FIGS. 18 and 19, a mechanism 1044 is provided for driving the turning member 1031 for intermittent rotation in timed relation to the mechanisms provided at stations ST1 to ST4. A disk 1046 is keyed to the lower end of the shaft 1041 and has a lower surface formed with four slide grooves 1045*a* to 1045*d* extending radially at right angles to one another. A lever 1049 is secured to a driving cam shaft 1047 and carries a roller 1048 which is engageable with one of the slide grooves. When the roller 1048 is rotated about the cam shaft 1047 in the direction of an arrow 1050 from its position shown in FIG. 19, it stays away from the disk 1046 during its rotation up to an angle of 270°, but engages the slide groove 1045*c* during its rotation from 270° to 360°, whereby the disk 1046 and the turning member 1031 are rotated by 90° in the direction of an arrow 1051.

The package supporting pegs 1042*a* to 1042*d* provided on the turning member 1031 will be described in further detail with reference to FIG. 20. All of the pegs are of the same construction and only the peg 1042*a* is, therefore, shown in FIG. 20. A supporting cylinder 1052 forms an integral part of the radially outer end of the arm 1043*a*. A rotating body 1054 having an axial bore is supported by bearings 1053 in the cylinder 1052.

A shaft 1056 extends through the axial bore of the rotating body 1054 and the peg 1042*a* is secured to the shaft 1056 by a screw 1055. The peg 1042*a* has a lower surface resting on the upper surface of the rotating body 1054. The peg 1042*a* has a hole 1060 in which a pin 1059 projecting from the rotating body 1054 is received, so that the peg may be rotatable with the rotating body 1054, while it is vertically slidable to and away from the rotating body 1054. A roller 1061 is screwed to the rotating body 1054. A roller in the wound form inspection station is engageable with the roller 1061 to rotate the rotating body 1054. Its rotation is transmitted to the peg 1042*a* by the pin 1059, so that the peg and the package PA supported thereon may be rotated about the shaft 1056.

Figure 20:
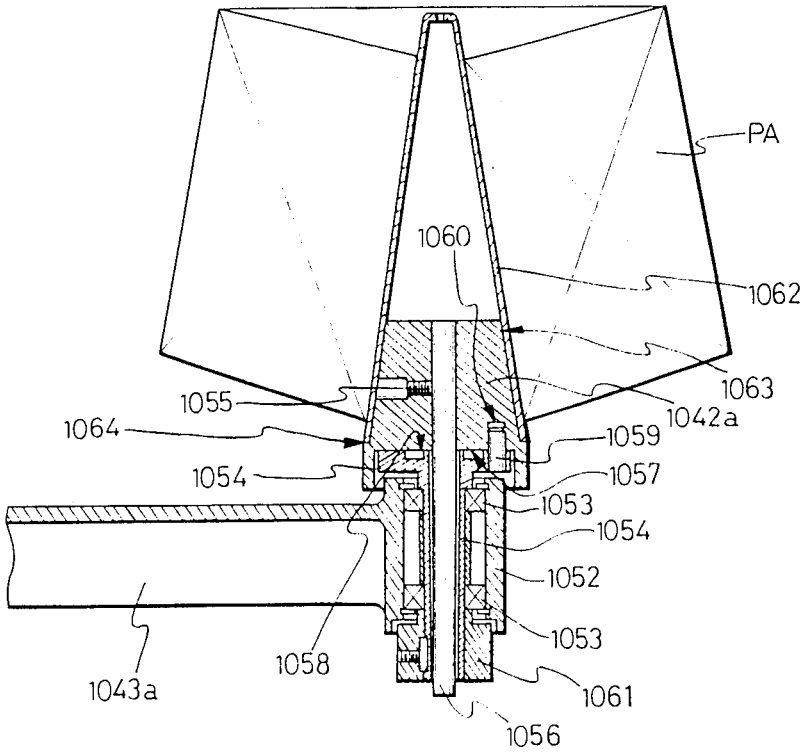

The package PA shown in FIG. 20 is a conical one. Therefore, the peg 1042*a* has a tapered outer surface 1063 which is complementary to the inner surface of a conical winding tube 1062. The peg has on its outer surface a shoulder 1064 on which the package PA is supported. The peg 1042*a* can, of course, have any other shape that suits the winding tube which the package to be handled contains.

When the package PA is weighed, the shaft 1056 is pushed up until the lower surface 1057 of the peg 1042*a* leaves the upper surface 1058 of the rotating body 1054. The weight of the package PA can be obtained from the force which has been required for pushing up the shaft 1056.

(ii) First inspection mechanism (weighing)

Figure 22:
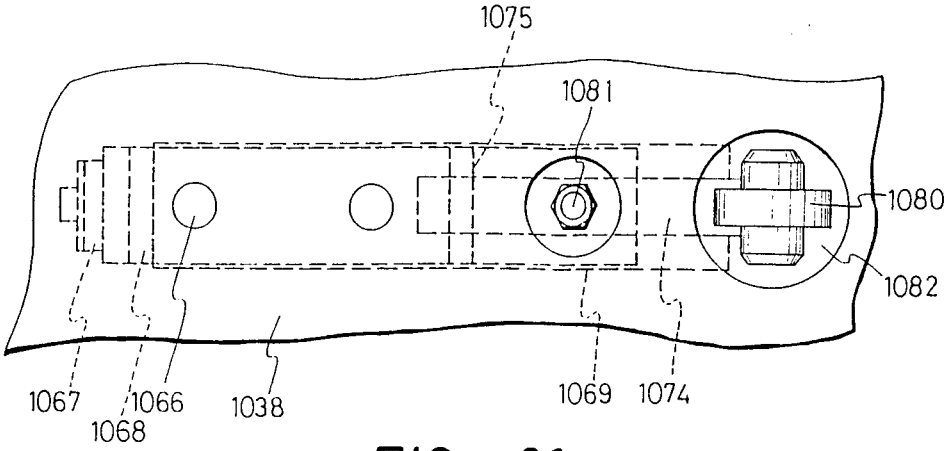
Figure 21:
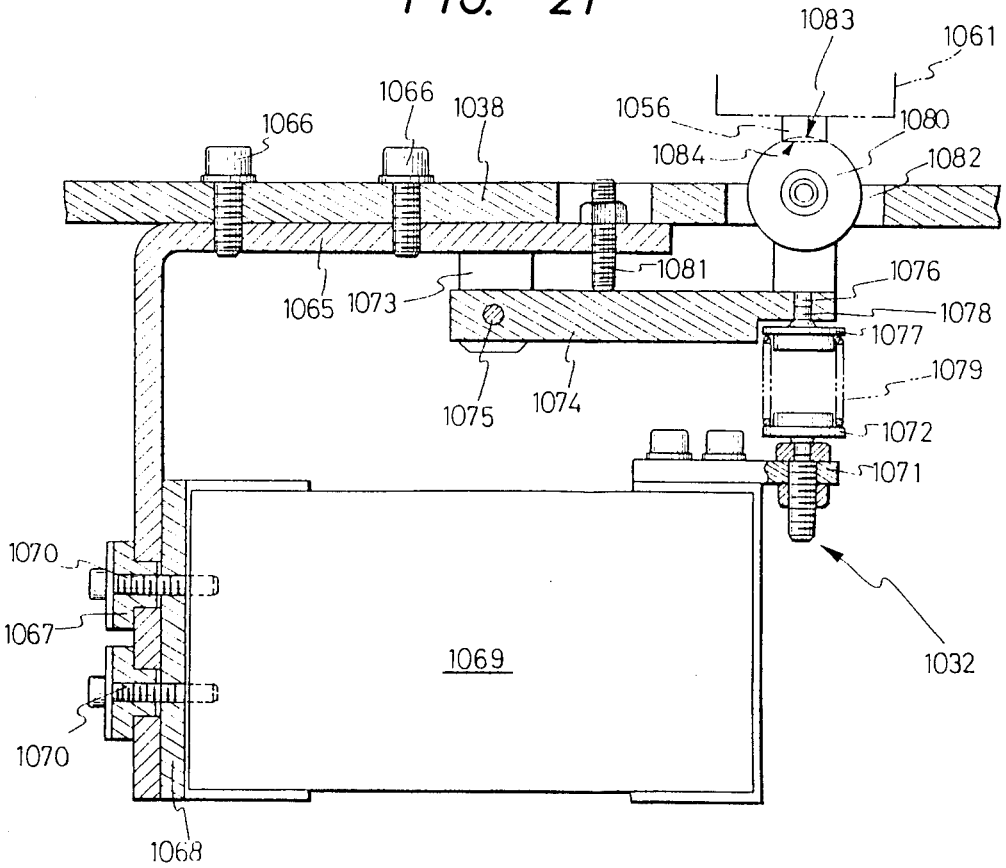

The first inspection device 1032 which is provided at the first inspection station ST1 as shown in FIG. 15 is shown in further detail in FIGS. 21 and 22. A bracket 1065 is secured to the frame 1038 by screws 1066. A load measuring instrument 1069 is connected to the bracket 1065 by screws 1070. Vibration damping elastic materials 1067 and 1068 are provided between the bracket and the screws and between the bracket and the instrument. The instrument 1069 has an actuating member 1071 in which a lower spring rest 1072 is inserted. A lever 1074 is supported by a shaft 1075 on a cantilever supporting member 1073 secured to the tracket 1065. The lever 1074 has a hole 1076 in which a pin 1078 projecting from an upper spring rest 1077 is received. A roller 1080 is secured to the free end of the lever 1074. A compression spring 1079 is disposed between the upper and lower spring rests 1077 and 1072 for urging the roller 1080 upwardly. A stop screw 1081 is provided for defining the uppermost position of the lever 1074. It is used for adjusting the position of the lever 1074 under no load. The frame 1038 has an opening 1082 through which the roller 1080 projects upwardly. The roller 1080 is located directly under the shaft 1056 extending through one of the pegs on the turning member 1031. The stop screw 1081 is so positioned as to maintain the uppermost portion 1083 of the roller 1080 slightly above the lowermost portion 1084 of the shaft 1056 under no load. The strength of the spring 1079 is such that when no package is mounted on the peg, the spring 1079 maintains the lever 1074 in contact with the stop screw 1081, while the shaft 1056 is raised to move the lower surface 1057 of the peg away from the upper surface 1058 of the rotating body, and that when a package is mounted on the peg, the lever 1074 is slightly lowered against the force of the spring 1079, while the lower surface 1057 of the peg still remains apart from the upper surface 1058 of the rotating body.

(iii) Second inspection mechanism (wound form inspection)

The second inspection device 1033 provided at the station ST2 as shown in FIGS. 18 and 19 is used for inspecting the wound form of each package. It is particularly suitable for inspecting the end surfaces of a layer of yarn on the package. The device 1033 comprises a source of light for radiating the surface 1085 of the layer of yarn on the package, an image sensor for taking an image of the light reflected by the surface 1085 and a device for analyzing the light information obtained by the image sensor to determine if the wound form is acceptable or not. A level signal which has been obtained is compared with an input level and if the former exceeds the latter, it indicates that the surface of the package has a portion which is defective in wound form.

The inspection device 1033 is provided above the package PA and another inspection device 1033*a* below it, as shown in FIG. 18, so that they may inspect the opposite surfaces 1085 and 1086, respectively, of the package PA. A friction roller 1087 is provided for rotating the package so that the whole area of each end surface of the package may be inspected. The friction roller 1087 is directly connected to the output shaft 1091 of a motor 1090 supported on a plate 1089 which is rotatable about a fixed shaft 1088. The friction roller 1087 is enageable with the roller 1061 keyed to the lower end of the rotating body 1054 (FIG. 20) to rotate the body 1054, the peg 1042*a* and the package mounted thereon.

A rod 1092 is connected to the other end of the plate 1089. The rod 1092 is driven by a cam on the cam shaft 1047 to move the plate 1089 between two positions. When the package is moving, the rod 1092 (FIG. 19) is in its advanced position to keep the friction roller 1087 apart from the roller 1061, so that the package may not be rotated. When the wound form of the package is inspected, the rod 1092 is withdrawn by the cam to move the plate 1089 to rotate the package with the peg 1042*a*.

(iv) Defective package discharging mechanism

The package which has been rejected by at least one of the first and second inspection mechanisms is removed from the peg 1042*c* by the discharging mechanism 1034 at the station ST3 (FIGS. 16 and 19). The mechanism 1034 comprises a pair of ejection levers 1036 located below the package at the station ST3 rotatably about a shaft 1093. A rod 1095 is connected to a cam lever 1094, a lever 1096 to the rod 1095 and a rod 1097 (FIG. 16) to the lever 1096. If the lever 1096 is rotated to push up the rod 1097, the levers 1036 are rotated from their standby positions shown by solid lines in FIG. 16 to their operative positions shown by broken lines 1036*a* to remove the package PA from the peg 1042*c*. The ejected package is received into a defective package container or onto a defective package conveyor beside a frame 1095. The cam lever 1094 for moving the ejection levers 1036 is actuated only when a cam plate which a cam follower 1097 engages is driven by a clutch mechanism in accordance with a defective package detecting signal stored in a memory, as will hereinafter be described in detail.

(v) Normal package transfer mechanism

The package transfer mechanism 1035 is provided at the station ST4 for receiving normal packages passing through the station ST3 and transferring them onto the conveyor 1018 (FIG. 15). The transfer member 1037 is secured to a vertical shaft 1098 for supporting the lower surface 1086 of the package PA. The member 1037 is horizontally rotatable between two positions and is also vertically movable. The member 1037 comprises an arm 1099 and a U-shaped supporting portion 1100 as shown in FIG. 15. Alternatively, it may comprise an arm 1099 and two supporting portions 1100 as shown in FIG. 19. Other modifications are also possible.

A gear 1101 is splined to the mid-portion of the shaft 1098 to which the transfer member 1037 is secured, so that the shaft 1098 may be rotatable with the gear 1101 and may also be vertically slidable through the gear 1101. A segment gear 1103 which is rotatable about a fixed shaft 1102 meshes with the gear 1101. A rod 1105 is connected between the segment gear 1103 and a cam lever 1104. A cam follower 1106 is movable by a cam plate to rotate the segment gear 1103 reciprocatively to thereby rotate the package transfer member 1037 between two positions 1037*a* and 1037*b* shown by broken lines in FIG. 15. A roller 1108 is carried on one end of a lever 1107 and contacts the lower end of the shaft 1098, as shown in FIG. 18. The lever 1107 is rotatable to raise or lower the roller 1108 and thereby the shaft 1098. A lever 1110 is connected to the lever 1107 by a shaft 1109. A rod 1112 has one end connected to a cam lever 1111, while the other end thereof is connected to the lever 1110, as shown in FIG. 19. A cam follower 1113 is movable with a cam plate to rotate the lever 1107 vertically. The vertical movement and rotation of the shaft 1098 are controlled by the respective cam plates in properly timed relationship to enable the removal of the package from the peg, its transfer to the conveyor 1018 and its lowering onto a tray on the conveyor 1018.

Figure 23:
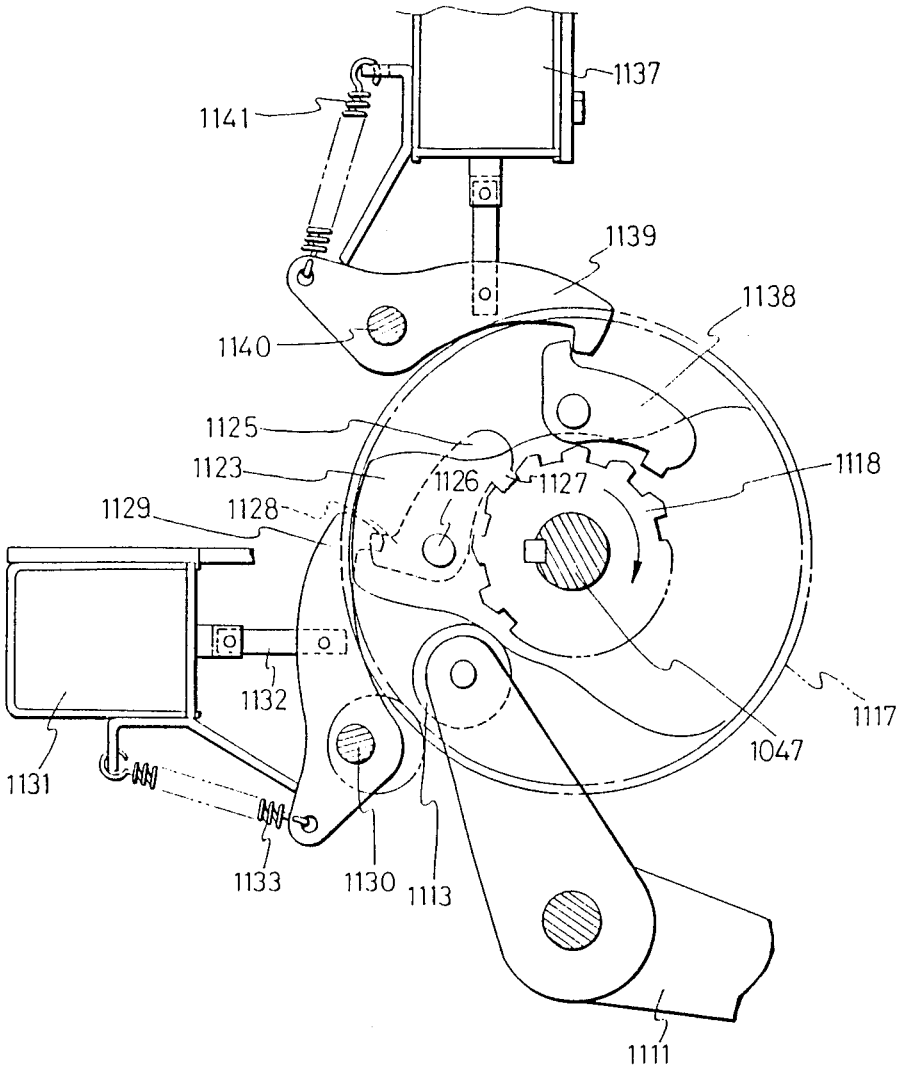
Figure 24:
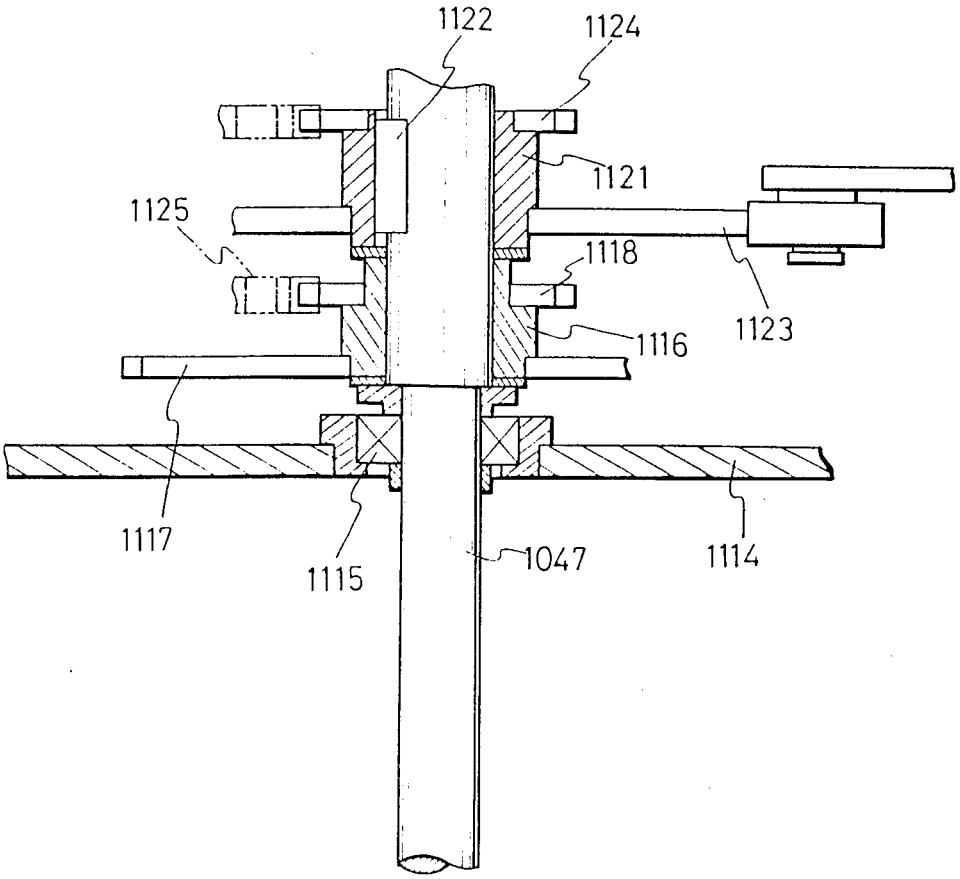

Reference is made to FIGS. 23 and 24 showing a clutch mechanism for the cam shaft 1047 and the cam plate for discharging defective packages. The shaft 1047 is supported by a bearing 1115 attached to a frame 1114. A boss 1116 is rotatably fitted about the cam shaft 1047. A gear 1117 and a ratchet wheel 1118 for the cam shaft are secured to the boss 1116. A driving gear 1120 is connected to a motor 1119 (FIG. 18) and meshes with the gear 1117 so that the ratchet wheel 1118 may always be rotatable.

Another boss 1121 is keyed to the cam shaft 1047 at 1122. A cam plate 1123 and a ratchet wheel 1124 for defective package ejection are fixed to the boss 1121. A ratchet 1125 is rotatably connected by a shaft 1126 to the cam plate 1123 and is engageable with the ratchet wheel 1118. The ratchet 1125 has a hook 1128 located remotely from its pawls 1127. A clutch member 1129 is rotatably supported on a fixed shaft 1130 and is engageable with the hook 1128. A solenoid rod 1132 which is movable forward or backward by an electromagnetic solenoid 1131 is connected to the clutch 1129. A spring 1133 urges the clutch 1129 into engagement with the ratchet 1125. A spring not shown urges the ratchet 1125 into engagement with the ratchet wheel 1118. If a cam shaft driving signal is inputted to the solenoid 1131, the clutch 1129 is rotated counterclockwide about the shaft 1130 and thereby disengaged from the ratchet 1125. The ratchet 1125 is engaged with the ratchet wheel 1118 which is constantly rotating and the cam plate 1123 supporting the ratchet 1125 is thereby rotated. Its rotation is transmitted to the cam shaft 1047 through the key 1122 (FIG. 24).

When the cam shaft 1047 is rotated, it causes the rotation of a cam plate 1134 provided at station ST2 for package rotation, the cam plates 1123 and 1135 provided at station ST4 for package transfer and the lever 1049 for the intermittent rotation of the rotating member. However, the cam plate 1136 provided at station ST3 for defective package ejection is rotated only when a solenoid 1137 (FIG. 23) is actuated. When the cam shaft 1047 is rotated, a ratchet 1138 (FIG. 23) supported on the cam plate 1136 is not engaged with the ratchet wheel 1124 (FIG. 24) when it is in its position shown by a solid line, but the ratchet wheel 1124 is only rotated in an idling way. If a defective package arrives at station ST3, a corresponding signal is transmitted to the solenoid 1137 so that a clutch 1139 may be rotated about a fixed shaft 1140 by overcoming the force of a spring 1141 and thereby disengaged from the ratchet 1138. Then, the ratchet 1138 is rotated by a spring not shown into engagement with the ratchet wheel 1124 so that it may rotate with the ratchet wheel to rotate the cam plate for defective package ejection.

Figure 25:
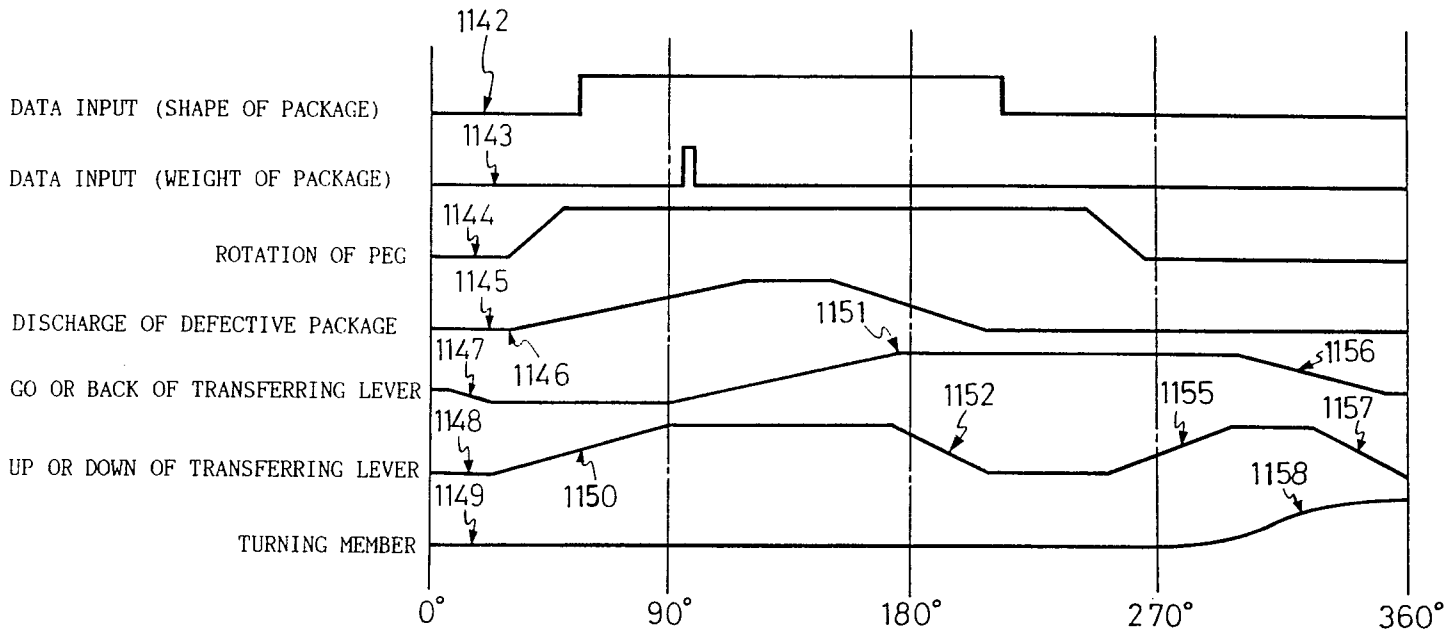
FIG. 25 is a chart showing the timing of operation of each mechanism or device in the inspection station.

FIG. 25 is a chart showing the timing of operation of the various mechanisms in the inspection station. A curve 1142 shows the readout timing of the image sensor at the wound form inspection station ST2. A curve 1144 shows the timing of rotation of the peg at the station ST2. The readout of the image sensor takes place within the rotation of the peg and therefore the package.

A curve 1143 shows the timing of data collection by the load measuring instrument at the weighing station ST1. A curve 1145 shows the timing of rejected package ejection at the station ST3. A point 1146 indicates the timing for the actuation of the solenoid 1137 (FIG. 23) to rotate the cam plate to thereby rotate the ejection lever.

A curve 1147 shows the horizontal rotation of the transfer lever at the normal package transfer station. A curve 1148 shows the vertical movement of the transfer lever. The lever 1037 is rotated from its standby position shown by a solid line in FIG. 15 to the station ST4 as shown at 1147 in FIG. 25 and is, then, raised as shown at 1150 in FIG. 25 to remove the package PA from the peg 1042*d*. Then, the lever 1037 is rotated counterclockwise in FIG. 15 to its position 1037*b* above the conveyor 1018 as shown at 1151 in FIG. 25, while staying in its raised position. It is, then, lowered as shown at 1152 in FIG. 25 to lower the package PA so that it may be received about the peg 1153 of the tray 1021A on the conveyor 1018. If a stopper 1154 is retracted, the tray 1021A is moved along with the conveyor. The lever 1037 is raised again as shown at aatt in FIG. 25, rotated back as shown at 1156 and lowered again as shown at 1157 so that it may be returned to its original position 1037 in FIG. 15.

A curve 1149 shows the timing of rotation of the turning member 1031. The turning member 1031 is designed for accomplishing each intermittent rotation thereof during the rotation of the cam shaft 1047 from an angle of 270° to 360° in such a manner that its intermittent rotation may somewhat overlap the final portion of each cycle of operation of the various mechanisms, as shown at 1158 in FIG. 25.

While the apparatus embodying this invention has been described as handling conical packages, it is also applicable to the inspection of cheese packages or various other shapes of packages produced by spinning or twisting frames, etc. While the inspection station has been described as inspecting the weight and wound form of each package, it can be modified to inspect only one of the two items or any other item such as the degree of dyeing or other aspects of appearance or the physical properties including yarn strength and twist number.

The inspection station can automatically inspect and convey the packages and separate the rejected packages from the accepted ones. None of the devices or members in the station contacts the surface of yarn on any package throughout its inspection or transportation. Therefore, it can effectively inspect a large number of packages without lowering their quality.

The operation of the package delivering devices 175 and 176 will now be described with reference to the transportation of the package PA of smaller radius r which is shown in FIG. 14. The package PA is conveyed by the hook 163 in the direction of an arrow 273 to an appropriate position above the delivering station, as shown in FIG. 4. The package is caused to stop at the appropriate position by means of the photoelectric sensor 172 shown in FIG. 2. The package is identified by the sensor 170*a* shown in FIGS. 2 and 3 and the information on the kind of the package is inputted to the control device 173.

A level signal indicating the weight or wound form of the package is obtained in the inspection station in response to a signal indicating the results of identification and is compared with the set value.

When the package PA has stopped at its position shown in FIG. 4, the first and second delivering devices 175 and 176 are raised, as hereinbefore described, to establish automatically their positional relationship as shown in the right half of FIG. 14. Then, the motor 192 on the vertically movable body 188 is rotated in the direction of the arrow 196 as shown in FIG. 5 and the two package receiving members 177 are rotated about the shafts 181 and 182 from their standby positions, while keeping their parallel relationship. When the members 177 pass through their positions 177*a* shown by a broken line in FIG. 4, the holding members 187*a* push the end surface 86 of the package PA to remove it from the hook 163 so that it may be received on the receiving members 177*a*. Then, the members 177*a* are rotated and when they pass through their positions 177*b* shown by a broken line in FIG. 4, the package is transferred onto the package receiving member 178 of the second delivering device 176, as shown in FIGS. 7 and 8. The receiving and holding members 177*b* and 187 are movable outwardly of the opposite surfaces 274 and 275 of the swinging body 221, as shown in FIG. 7, so that only the package may be left on the receiving member 178.

The swinging body 221 in the second delivering device 176 begins to move down and rotate as soon as the sensors or sequence control devices confirm that the package receiving members 177*b* have moved back to their standby positions, that the package supplying peg in the inspection station does not carry any package, and that the package receiving member 178 carries a package.

If the motor 248 shown in FIGS. 11 and 12 is driven to rotate the screw shaft 243, it lowers the vertically movable body 244 by the distance S1 shown in FIG. 4. If the motor 263 is driven to rotate the swinging shaft 220 by 90° clockwise as viewed in FIG. 4, the swinging body 221 is swung from its vertical position to its horizontal position and the package PA is inserted about the peg 42*a* in the inspection station, while its end surface is supported on the arms 229 and 230 of the package receiving member 178. The shaft 220 stops after rotating over a certain angle which is restricted by the iron member 264 secured to the gear 262 as shown in FIG. 12 and the proximity sensor 265 provided on the vertically movable body 244.

Then, if the motor 236 shown in FIG. 8 is driven, its rotation is transmitted through the gears 238, 233 and 234 to cause the shafts 231 and 232 carrying the arms 227 and 228 to rotate in the opposite directions by an an angle of about 90° each, whereby the arms 227 and 228 are rotated away from each other in the directions of the arrows 276 and 277, respectively. When they are moved away from the outer surface of the package, the swinging shaft 220 is rotated in the opposite direction to return the swinging body 221 to its vertical position and the arms 227 and 228 are moved back toward each other and wait for another package.

Although the apparatus has been described for handling two kinds of conical packages, it can also be used for handling cylindrical cheese packages. In this case, the package receiving members 177 of the first delivering device 175 and the package receiving member 178 of the second delivering device 176, which are shown in FIG. 4, are often designed for having horizontal package supporting surfaces.

The apparatus of this invention can be effectively used with a system for manufacturing many kinds of products each in a small quantity, since the operation of the delivering devices for receiving packages and delivering them to a particular place can be finely controlled in accordance with the size of the package to be handled.

What is claimed is:

1. A system for delivering and inspecting packages including an apparatus for deliverying packages and an inspecting device of packages delivered from said apparatus characterized in that said apparatus for delivering packages comprises a first receiving and delivering device for receiving packages from a path of their transportation and delivering said packages to a first location and a second receiving and delivering device for receiving said packages at said first location and delivering them to said inspecting device, each of said first and second receiving and delivering devices including a package receiving member and a mechanism for changing the package receiving position of each said package receiving member in accordance with the kind of said package.

2. A system for delivering and inspecting packages as claimed in claim 1, wherein a mechanism for identifying the kind of packages is provided at a package transportation position on an overhead travelling conveyor line.

3. A system for delivering and inspecting packages as claimed in claim 2, wherein said mechanism for identifying the packages comprises a guide plate formed as an integral part of a hook for carrying the packages along the overhead travelling conveyor line, a plurality of cams provided on the guide plate, a plurality of first levers provided at corresponding positions of said cams, and a plurality of proximity sensors at corresponding positions of the first levers.

4. A system for delivering and inspecting packages as claimed in claim 1, wherein said package receiving member of the first receiving and delivering device comprises a pair of first package receiving members connected at one end to each other by a bar and a pair of first package holding members secured on the first package receiving members.

5. A system for delivering and inspecting packages as claimed in claim 4, wherein said first receiving and delivering device further comprises a link mechanism including shafts and levers connected to said package receiving member to rotate the pair of first package receiving members synchronously and in parallel, and said mechanism for changing the package receiving position comprises vertically movable members including a screw shaft, a vertically movable frame to which the screw shaft is secured and a motor which is connected with the screw shaft through gears, so that the vertically movable frame adjusts the position of the package receiving member in accordance with the diameter of the package which they are going to receive.

6. A system for delivering and inspecting packages as claimed in claim 1, wherein said second receiving and delivering device comprises a swinging shaft which is vertically movable and rotated over a certain angular range, a swinging body rotatably supported on the swinging shaft, and a package receiving member which is vertically movably supported on the swinging body.

7. A system for delivering and inspecting packages as claimed in claim 6, wherein a mechanism for moving vertically and rotating said swinging shaft comprises a vertically movable body supporting said swinging shaft through bearings and including gears secured at one end of the swinging shaft, a motor connected to the gears and a dog secured to one of the gears to determine the rotating angle of the swinging shaft, and a vertically driving mechanism which includes a ball screw which is secured to the vertically movable body, a screw shaft threadedly engaged with the ball screw, and a motor connected to the screw shaft through gears.

8. A system for delivering and inspecting packages as claimed in claim 6, wherein said swinging body includes a supporting rod which is secured to the bottom of the package receiving member to move the package receiving member in accordance with the diameter of the package to be received and delivered, an iron member secured to the lower end of the supporting rod, and a pair of sensor groups secured to the swinging body and actuated by the iron member.

9. A system for delivering and inspecting packages as claimed in claim 8, wherein a pair of package supporting arms are supported on the swinging body for movement toward and away from each other.

10. A system for delivering and inspecting packages as claimed in claim 1, wherein said inspecting device comprises an indexed turning member for supporting packages and rotating intermittently, at least one inspection mechanism, a mechanism for ejecting a defective package and a mechanism for delivering an accepted package, said mechanisms each being located in an index position of the turning member.

11. A system for delivering and inspecting packages as claimed in claim 10, wherein said turning member includes a vertical shaft and a driving mechanism, radial arms located on the vertical shaft at equal intervals and having a length corresponding to a circle having its center at the vertical shaft and a peg provided on each arm for supporting a package.

12. A system for delivering and inspecting packages as claimed in claim 11, wherein each said peg is fitted on the upper surface of a rotating body so that the peg may be rotatable with the rotating body, while the peg is vertically slidable toward and away from the rotating body.

13. A system for delivering and inspecting packages as claimed in claim 12, wherein said at least one inspection mechanism includes a package weighing mechanism which comprises a bracket, a load measuring instrument located on the bracket and having an actuating member, and a roller supported by the bracket and being urged upwardly by a compression spring disposed between the roller and the actuating member, said roller being located directly under a shaft extending through the peg of the turning member.

14. A system for delivering and inspecting packages as claimed in claim 10, wherein said at least one inspection mechanism includes a wound form inspection mechanism for inspecting the wound form of each of package and said wound form inspection mechanism comprises a source of light for radiating the surface of the layer of yarn on the package, an image sensor for taking an image of the light reflected by the surface and a device for analyzing the light information obtaied by the image sensor to determine if the wound form is acceptable or not.

15. A system for delivering and inspecting packages as claimed in claim 14, wherein a first wound form inspection device is provided above the package, another second wound form inspection device is provided below the package and a friction roller is provided for rotating the package so that the whole area of each end surface of the package may be inspected.

16. A system for delivering and inspecting packages as claimed in claim 10, wherein said mechanism for ejecting a defective package which has been rejected by said at least one inspection mechanism comprises a pair of ejection levers located below the package rotatably about a shaft and means for driving the ejection levers.

17. A system for delivering and inspecting packages as claimed in claim 10, wherein said mechanism for delivering an accepted package comprises a transfer member for supporting the lower surface of the package horizontally rotatable between two positions and vertically movable.

* * * * *